US010850755B2

(12) United States Patent
Lefebvre et al.

(10) Patent No.: US 10,850,755 B2
(45) Date of Patent: Dec. 1, 2020

(54) SYSTEM AND METHOD FOR BUILDING AND MANAGING A TRAIN CONSIST

(71) Applicant: AMSTED RAIL COMPANY, INC., Chicago, IL (US)

(72) Inventors: William Lefebvre, West Chester, PA (US); Matthew Bonnes, Malvern, PA (US); Darren Dragish, Downingtown, PA (US); Andrew Martin, West Chester, PA (US); Thomas P. Fuhs, Phoenixville, PA (US)

(73) Assignee: Amsted Rail Company, Inc., Chicago, IL (US)

( * ) Notice: Subject to any disclaimer, the term of this patent is extended or adjusted under 35 U.S.C. 154(b) by 404 days.

(21) Appl. No.: 15/759,235

(22) PCT Filed: May 27, 2016

(86) PCT No.: PCT/US2016/034715
§ 371 (c)(1),
(2) Date: Mar. 12, 2018

(87) PCT Pub. No.: WO2016/191711
PCT Pub. Date: Dec. 1, 2016

(65) Prior Publication Data

US 2018/0319414 A1 Nov. 8, 2018

Related U.S. Application Data

(60) Provisional application No. 62/167,015, filed on May 27, 2015, provisional application No. 62/244,543, filed on Oct. 21, 2015.

(51) Int. Cl.
*B61L 25/02* (2006.01)
*B61L 15/00* (2006.01)
(Continued)

(52) U.S. Cl.
CPC ..... *B61L 25/028* (2013.01); *B61L 15/0027* (2013.01); *B61L 15/0072* (2013.01);
(Continued)

(58) Field of Classification Search
CPC .. B61L 15/00; B61L 15/0018; B61L 15/0027; B61L 15/0081; B61L 15/0054;
(Continued)

(56) References Cited

U.S. PATENT DOCUMENTS 5,682,139 A 10/1997 Pradeep et al.
5,691,980 A 11/1997 Welles, II et al.
(Continued)

FOREIGN PATENT DOCUMENTS

EP 1548419 A1 6/2005
EP 1720754 B1 2/2009
(Continued)

OTHER PUBLICATIONS

European Patent Office—Extended Search Report dated Mar. 21, 2019, issued in EU application 16800817.5, which is related to the subject U.S. Application.
(Continued)

*Primary Examiner* — Jason C Smith
(74) *Attorney, Agent, or Firm* — Fox Rothschild LLP; Gary A. Hecht; Carol E. Thorstad-Forsyth

(57) ABSTRACT

Railyard management system for managing, assembling, disassembling and validating train consists and monitoring railcars in the railyard. The system provides for the collection of data and the movement of data from lower processing levels to higher processing levels, where an inference engine draws inferences regarding the current state of railcars and train consists within the railyard. The inferences are assigned confidence levels based on the methods and available data used to draw the inferences. The system can be
(Continued)

used to track the location and orientation of railcars in the railyard and to validate order and orientation of assets in a train consist.

28 Claims, 13 Drawing Sheets

(51) Int. Cl.
*B61L 17/00* (2006.01)
*B61L 25/04* (2006.01)
*B61L 27/00* (2006.01)

(52) U.S. Cl.
CPC ..... *B61L 25/025* (2013.01); *B61L 15/0054* (2013.01); *B61L 17/00* (2013.01); *B61L 25/04* (2013.01); *B61L 27/0005* (2013.01); *B61L 27/0077* (2013.01); *B61L 27/0094* (2013.01); *B61L 2205/04* (2013.01)

(58) Field of Classification Search
CPC ..... B61L 15/0072; B61L 17/00; B61L 25/02; B61L 25/028; B61L 27/0077; G06Q 10/06; G06Q 10/0631
See application file for complete search history.

(56) References Cited

U.S. PATENT DOCUMENTS 5,986,547 A * 11/1999 Korver ..... G01S 5/0247 246/121
6,175,784 B1 1/2001 Jicha et al.
6,184,798 B1 2/2001 Egri
6,301,531 B1 10/2001 Pierro et al.
6,339,397 B1 1/2002 Baker
6,441,324 B1 8/2002 Stimpson
6,487,478 B1 11/2002 Azzaro et al.
6,535,135 B1 3/2003 French et al.
6,668,216 B2 12/2003 Mays
7,336,156 B2 2/2008 Arita et al.
7,688,218 B2 * 3/2010 LeFebvre ..... B61L 27/0077 340/682
7,698,962 B2 4/2010 LeFebvre et al.
8,060,264 B2 11/2011 Oestermeyer et al.
8,212,685 B2 7/2012 LeFebvre et al.
8,244,411 B2 8/2012 Baker
8,370,006 B2 2/2013 Kumar et al.
8,672,273 B2 3/2014 Brown et al.
8,751,290 B2 6/2014 Schullian et al.
8,820,685 B2 9/2014 Michaut
9,365,223 B2 6/2016 Martin et al.
9,744,980 B2 8/2017 Henry et al.
2003/0182030 A1 * 9/2003 Kraeling ..... B61L 15/0081 701/19
2004/0117076 A1 6/2004 Horst
2004/0201464 A1 10/2004 Oonishi
2005/0259619 A1 11/2005 Boettle et al.
2006/0264221 A1 11/2006 Koike et al.
2006/0290478 A1 12/2006 Stull et al.
2007/0005200 A1 1/2007 Wills et al.
2007/0156307 A1 7/2007 Muinonen et al.
2007/0241610 A1 10/2007 Smith
2008/0097659 A1 * 4/2008 Hawthorne ..... B61L 17/00 701/19
2008/0195265 A1 8/2008 Searle et al.
2008/0252515 A1 10/2008 Oestermeyer et al.
2009/0173840 A1 7/2009 Brown et al.
2009/0299623 A1 12/2009 Weiler
2010/0032529 A1 * 2/2010 Kiss ..... B61L 17/02 246/122 R
2010/0200307 A1 8/2010 Toms
2010/0302974 A1 12/2010 Niiyama et al.
2011/0270475 A1 11/2011 Brand et al.
2011/0282540 A1 11/2011 Armitage et al.
2012/0051643 A1 3/2012 Ha et al.
2012/0072266 A1 3/2012 Schullian et al.
2013/0116865 A1 * 5/2013 Cooper ..... B61L 17/00 701/20
2014/0089243 A1 * 3/2014 Oppenheimer .... G06K 7/10009 706/46
2014/0372498 A1 * 12/2014 Mian ..... B61L 15/0027 709/201
2014/0375497 A1 * 12/2014 Friend ..... G01S 19/14 342/357.51
2015/0060608 A1 * 3/2015 Carlson ..... B60T 8/1705 246/122 R
2015/0083869 A1 3/2015 LeFebvre et al.
2015/0148984 A1 * 5/2015 Padulosi ..... B61L 25/028 701/1
2018/0319414 A1 * 11/2018 Lefebvre ..... B61L 25/025

FOREIGN PATENT DOCUMENTS

EP 2650191 A1 10/2013
JP 05213195 A 8/1993
JP 05343294 12/1993
JP 08015099 1/1996
JP 10217968 8/1998
JP 11192948 7/1999
WO 2005105536 A1 10/2005
WO 2009/020777 A1 2/2009
WO 2015/081278 A1 6/2015
WO 2016191711 A1 1/2016

OTHER PUBLICATIONS

Examination report dated Apr. 12, 2019 issued in related Australian Patent Application No. 2016267277.
Office Action dated Apr. 17, 2019 issued in related Canadian Patent Application No. 2,984,626.
Examination report dated Feb. 25, 2020 issued in related Indian Patent Application No. 201747042408.
Chinese Office Action dated Sep. 2, 2019, with English translation, issued in related Chinese application 201680030522.3. This 2nd action cites to references cited in the first office action made of record in this case dated Mar. 18, 2019.
Chinese Office Action dated Mar. 1, 2019, with English translation, issued in related Chinese application 201680030522.3.
http://web.archive.org/web/20130206222004/http://lat-lon.com/gps-products/- locomotive-monitoring-unit,http://web.archive.org/web/20130206221020/http://lat-lon_com/gps-products- /solar-tracking-unit http://web.archive.org/web/20130205074831/http://lat-lon.com/gps-products- -sensors Available on the Internet at least as early as Feb. 6, 2013.
Printout of web pages found at http://lat-lon.com/ Available on the Internet at least as early as Sep. 23, 2013.
Printout of web pages found at http://www.skybitz.com/ Available on the Internet at least as early as Sep. 23, 2013.
Printout of web pages found at http://www.transcore.com/ Available on the Internet at least as early as Sep. 23, 2013.
Office Action dated Oct. 16, 2018, with English Translation, issued in Russia Application No. 2017140848, which is related to the present application.
Office Action dated Nov. 7, 2018, issued in Australia Application No. 2016267277, which is related to the present application.
Office Action dated Aug. 13, 2018, issued in Canada Application No. 2984626, which is related to the present application.

* cited by examiner (b)

(a)

(b)

(a)

SYSTEM AND METHOD FOR BUILDING AND MANAGING A TRAIN CONSIST

RELATED APPLICATIONS

This application claims the benefit of U.S. Provisional Patent Application Ser. No. 62/167,015, filed May 27, 2015 and U.S. Provisional Patent Application Ser. No. 62/244,543, filed Oct. 21, 2015, which are incorporated herein by reference in their entireties.

BACKGROUND OF THE INVENTION

It has become increasingly important for railway owners and operators to be able to locate and organize assets, including railcars, locomotives and train consists on a real time basis. From an operational point of view, it is important for railway operators to determine whether a railcar is located within or outside the boundaries of a railyard, is moving or stationary, and whether or not the railcar is part of a train consist or not linked to other railcars.

The knowledge of the status of railcars allows an operator to determine if railcars are being utilized or idle at any given point in time and provides means to help in the management of railyard operations.

As current industry practice, the management of train consists and railyards in railroad operations relies on reading, at fixed points in the rail network, passive radio frequency identification (RFID) tags which are affixed to each railcar. While this method provides railroad operators with check-in/check-out list of assets, it lacks the benefits of a dynamic wireless network capable of transmitting timely information, such as location, status, condition, and/or performance data when not in range of an RFID reader. Additionally, the information typically encoded into an RFID tag is static and therefore, the RFID tag is not capable of providing the current status of the railcar. Further, currently systems do not provide a mechanism to validate a train consist before it leaves the railyard. Mistakes are possible when a train consist is created, and the result of such mistakes can be missing, incorrect or extra railcars in the train consist. There is also a safety risk that can be associated with using human intervention to visually validate a train consist before it departs a railyard.

It is therefore desirable to provide a train consist management system in a railyard to ease the management of creating and validating train consists. It is intended to eliminate mistakes and to mitigate the safety risks to humans carrying out the manual process of the current systems. Additionally, automating the process improves the efficiency of the management of the railyard, thereby reducing costs.

Given the demanding and harsh environments in which railroad trains operate, any monitoring system must be rugged, reliable and able to operate for long periods with little or no maintenance. Because there are more than 1.5 million freight railcars in North America alone, and many millions more around the world, a system of monitoring all railcars, both in use and idle in a railyard, is highly desirable and, as such, the system needs to be scalable to handle a very large number of potential devices.

Train/Rail communication and sensor systems are disclosed in U.S. Pat. No. 7,688,218 issued Mar. 30, 2010, U.S. Pat. No. 9,026,281 issued May 5, 2015, U.S. patent publication 2013/0342362 published Dec. 26, 2013, PCT application PCT/US2014/067739 filed Nov. 26, 2014, and PCT application PCT/US2014/072380 filed Dec. 24, 2014, the full disclosures of all of these are incorporated herein by reference.

SUMMARY OF THE INVENTION

It is an objective of this invention to provide a comprehensive system which allows the collection of data and the analysis of that data to perform one or more of the following functions:

- detect the presence of railcars within a railyard;
- determine the location and orientation of railcars in the railyard;
- logically monitor the assembly of train consists;
- determine the order and orientation of railcars in a train consist
- validate the order of railcars in a train consist and the orientation of railcars within a train consist
- provide adequate warnings when the railcar order of a train consist is incorrect thus allowing for intervention by humans or automated systems before an operational failure occurs; and
- provide an analysis capability to determine the severity and priority of events and warnings at different levels of processing.
- Determine operational status of railcars in the railyard (loaded, unloaded, handbrake applied, etc.)

In one preferred embodiment, and with reference to FIG. 1, the present invention consists of a system and method for building and managing a train consist, and includes the following:

A train-based mesh network system 107 using a wireless mesh network to provide bi-directional communication from freight railcars 103(*a*) or 103(*b*) in the train consist 109 to a host or control point.

A Powered Wireless Gateway device (PWG) 102 to manage the train-based mesh network 107 and communicate events from individual railcars 103(*a*) or 103(*b*) to the locomotive engineer or to other train management systems.

A Powered Wireless Gateway device 102 capable of receiving multiple sensor events from individual railcars and making an inference about the order of the railcars in a train consist 109.

A Powered Wireless Gateway device 102 capable of receiving information from an external control center or data system that specifies the freight railcars 103(*a*) or 103(*b*) that should be in the train consist 109 allowing only those railcars 103(*a*) or 103(*b*) to join and reporting any railcars 103(*a*) or 103(*b*) that are absent.

A Communication Management Unit (CMU) 101 on each railcar 103 capable of being a wireless node in the train-based mesh network 107 and being able to send messages to a host or control point.

A Communication Management Unit 101 on each railcar capable of using built-in sensors and/or managing a wireless sensor node 104 network on the freight railcar 103 to generate messages that need to be sent to locomotive host or control point.

A Communication Management Unit 101 on each railcar 103 capable of supporting a global navigation satellite system (GNSS) sensor to determine location, direction or speed of the freight railcar 103.

A Communication Management Unit 101 on each railcar 103 capable of using a compass.

A Communication Management Unit 101 on each railcar 103 capable of using a motion sensor.

A Communication Management Unit 101 on each railcar 103 capable of using one or more accelerometers for impact detection.

A Communication Management Unit 101 on each railcar 103 capable of using one or more accelerometers for motion sensing.

A Communication Management Unit 101 on each railcar 103 capable of supporting one or multiple geo-fences.

A Communication Management Unit 101 on each railcar 103 capable of indicating presence of an RFID reader.

A Communication Management Unit 101 on each railcar 103 capable of determining presence of mesh network and signal strength.

A Wireless Sensor Node 104 containing a temperature sensor and an accelerometer.

A Wireless Sensor Node (WSN) containing a motion sensor.

A Wireless Sensor Node 104 containing other sensors.

A managed railyard or unmanaged location with one or more Powered Wireless Gateway(s) 102 present.

A train consist 109 where a train consist is defined as a connected group of railcars 103 and locomotives 108 that form a complete train.

The train-based mesh network system 107 used to build and manage a train consist also can be used for event and alert transmission, both during the formation of the train consist 109 (to a control center), as well as after it is complete (to the control center or locomotive 108).

DEFINITIONS

Figure 1:
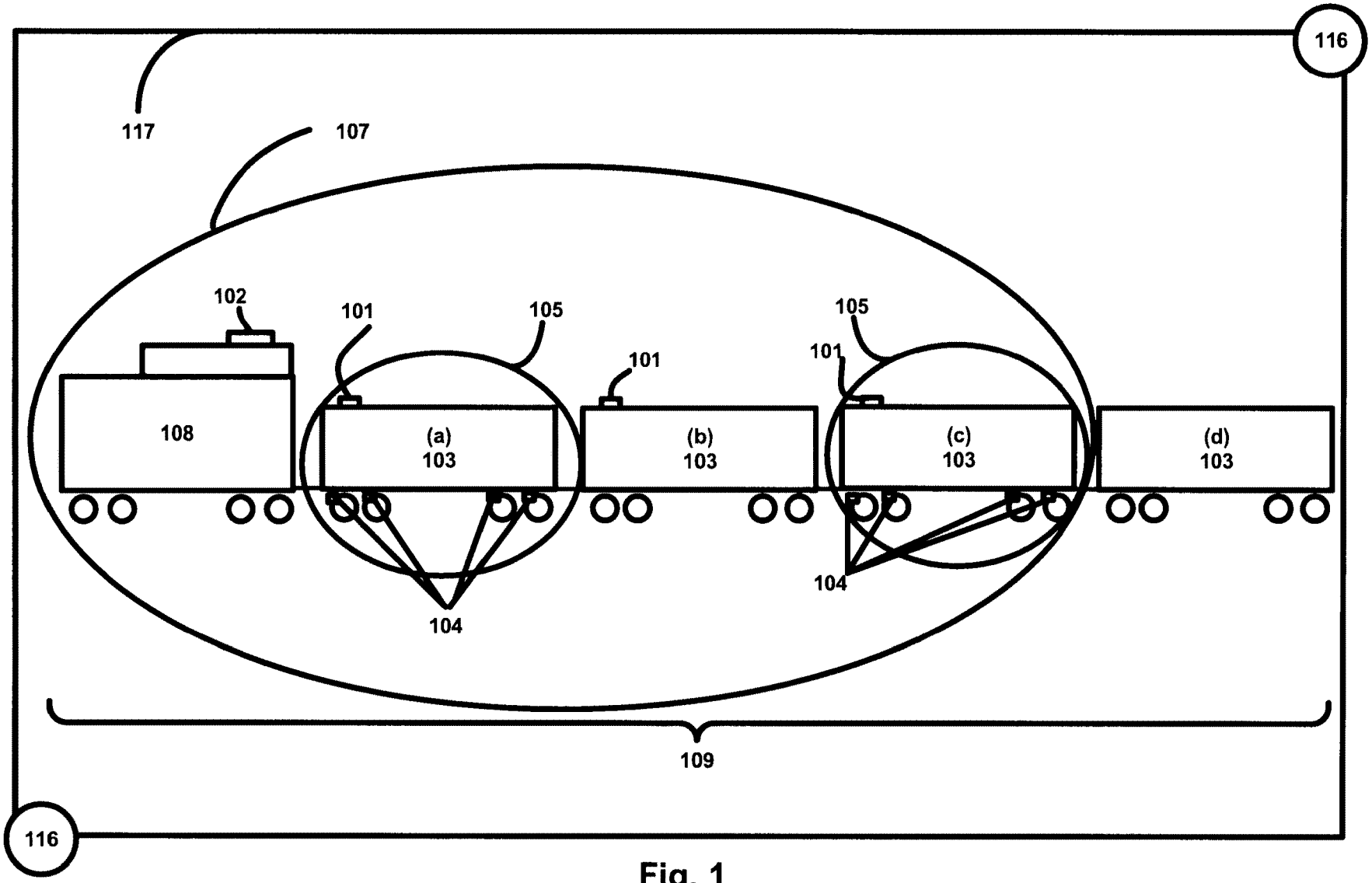
FIG. 1 is a diagram illustrating a train consist monitoring system and related hardware components.

A train consist, shown in the drawings as reference number 109, is defined as a connected group of railcars and locomotives.

Figure 4:
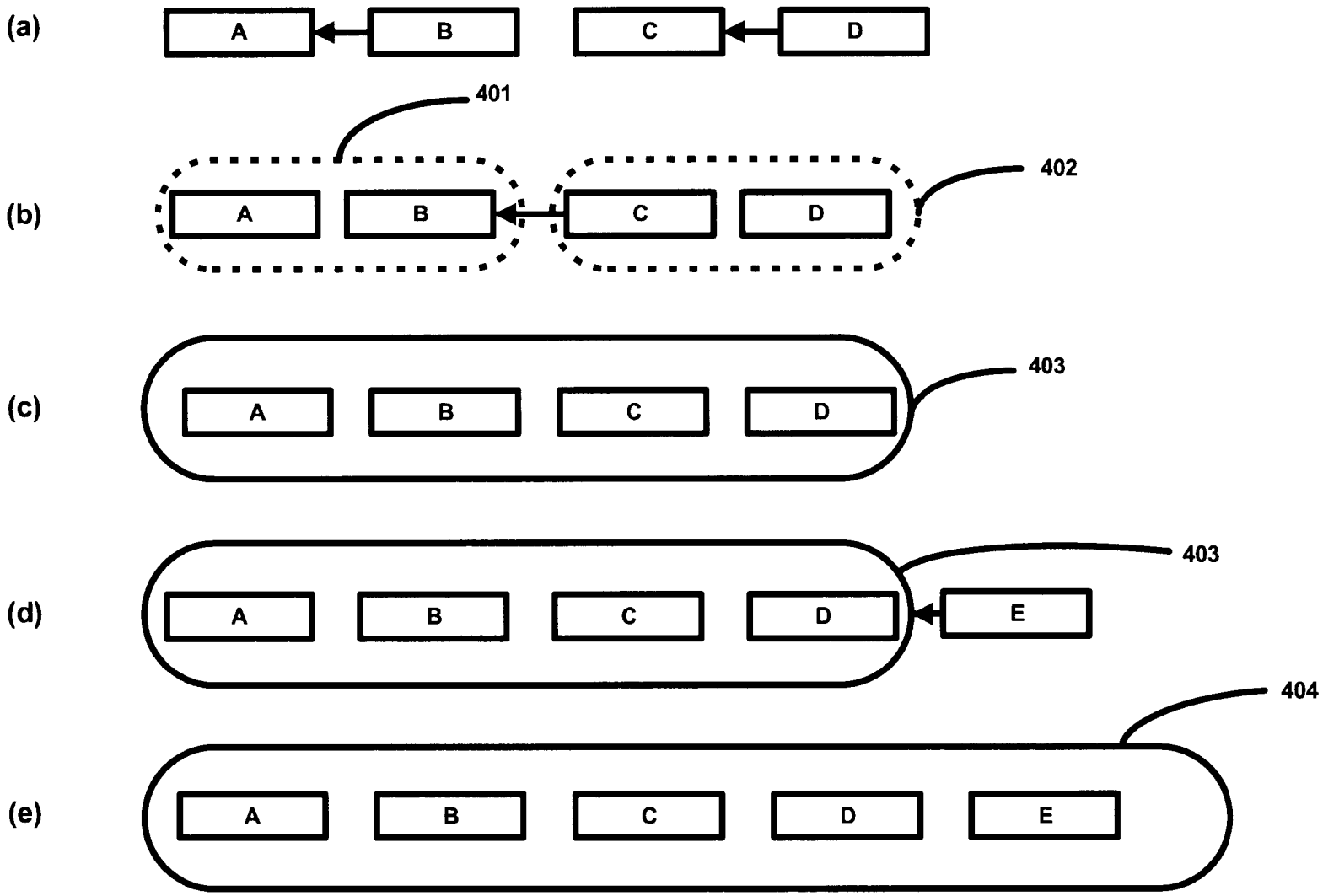
FIG. 4 is a diagram illustrating how railcars can be linked so that a train consist can be formed.

A link, shown for example in FIG. 4, is defined as two or more railcars coupled together.

A computing device is defined as any machine capable of processing and executing software to perform calculations or otherwise provide functionality. The computing device shall also have data storage and network communication capabilities to perform the functions required by this invention. A computing device includes, but is not limited to, a server, PC, or PWG 102, as described in this document.

A manager is defined as any device that is capable of linking together nodes in a mesh network on a time synchronized schedule and maintaining that link schedule such that reliable bi-directional communication is possible between all nodes in the network and with the manager. The manager may also provide a user interface to another network host for front end communication. A manager includes, but is not limited to, a PWG 102 or CMU 101, as described in this document.

A node is defined as any device that is capable of bi-directional wireless communications with another device to transmit and receive data. A node includes, but is not limited to, a CMU 101 or WSN 104, as described in this document A sensor is defined as any device that detects or measures a physical property and records the result, or transmits a resulting signal. One or more sensors may be present on a PWG 102, CMU 101, or WSN 104, as described in this document A wireless sensor node ("WSN"), shown in the drawings as reference number 104, is typically located on a railcar 103(*a*) or 103(*b*), is deployed preferably in a self-contained, protective housing, and may include one or more sensors, a power source, circuitry to read the sensor(s) and convert the readings to a digital form, and communication circuitry which allows the WSN to wirelessly transmit the sensor readings to an external receiver. The wireless sensor nodes are used for sensing a parameter to be monitored (e.g. temperature of, for example, bearings or ambient air) or status (e.g., position of a hatch or hand brake). The WSN may also include an intelligence capability, implemented as software running on an embedded microprocessor to analyze the data and determine if the data needs to be transmitted immediately, held for later transmission, or aggregated into an alert. WSNs are typically a member of a wireless mesh network managed by either a CMU or a PWG.

A communications management unit ("CMU"), shown in the drawings as reference number 101, is typically located on a railcar 103 and optionally acts as a manager for the railcar-based wireless mesh network 105 overlaid on the railcar. The CMU hardware preferably includes a processor, a power source, for example, a battery, a global positioning system ("GPS") receiver, Wi-Fi and/or cellular capability, a wireless communications capability for maintaining the mesh network, and, optionally, one or more sensors, such as, but not limited to, an accelerometer or temperature sensor. The CMU may support one or more WSNs in a mesh configuration using the IEEE 2.4 GHz 802.15.4 radio standard. Additionally, the CMU is also a member of either a train-based wireless mesh network, which consists of the CMUs from all enabled railcars in the train consist; controlled by a manager, preferably a powered wireless gateway (PWG), typically located on a powered locomotive; is a member of a railyard-based wireless mesh network, controlled by one or more managers, preferably powered wireless gateways dispersed throughout the railyard; or operating independently outside of a wireless mesh network. The CMU thus supports at least four functions: 1) to support built-in sensors, such as an accelerometer, within the CMU to monitor specific attributes of the railcar such as location, speed, accelerations and more; and 2) to support bi-directional communication to the powered host or control point, such as a locomotive and/or an off-train monitoring and control center; 3) to consolidate data from built-in sensors, and/or any number of WSNs in the railcar-based wireless mesh network and to apply logic to the data gathered to generate warning alerts to a powered host such as a locomotive or remote control center; and 4) to manage a low-power wireless mesh network overlaid on a railcar.

The CMU is capable of receiving data and/or alarms from one or more WSNs, or generating data and/or alarms directly, and is capable drawing inferences from this data or alarms regarding the performance of railcar 103, and of transmitting data and alarm information to a remote receiver. The CMU is preferably a single unit that would serve as a communications link to other locations, such as a mobile base station (e.g., the locomotive 108), a land-based base station, etc., and have the capability of processing the data received. The CMU also communicates with, controls and monitors WSNs (when present) in the local railcar-based wireless mesh network. Preferably, the placement of the CMU on each railcar will be consistent, as the placement will be useful in making determinations of the order and orientation of railcars within a train consist, as described later.

A powered wireless gateway ("PWG"), shown in the drawings as reference number 102, is preferably located either on a locomotive or deployed as part of a railyard-based wireless mesh network. It typically will include a processor, a GNSS receiver, a satellite and or cellular communication system, an Ethernet port and a high capacity network manager. The PWG will have power supplied by the locomotive, if located in the locomotive, or will derive its power from another source. The PWG acts as the manager of a wireless mesh network overlaid on a train consist (a train-based wireless mesh network, as define below), consisting of multiple CMUs from each railcar in a train, or is a member of a wireless mesh network overlaid on a railyard (a railyard-based mesh network, as defined below), consisting of other PWGs and CMUs from individual railcars not currently associated with a train consist. PWGs can communicate and manage WSNs directly, without requiring the presence of a CMU. The PWG, if located on a powered asset, such as a locomotive 108, will derive power from the powered asset, or will derive its power from another source, for example, from a solar power generator or from a high capacity battery.

The PWG collects data and draws inferences regarding the performance of the train consist, as opposed to CMUs, which draw inferences regarding the performance of individual railcars.

A dark railcar is a railcar equipped with a CMU but which is not connected or associated with a train-based wireless network or a railyard-based wireless network, as defined below.

A railcar-based wireless mesh network shown in the drawings as reference number 105, consists of a CMU on a railcar 103, which is part of and manages a mesh network of a plurality of WSNs, each deployed, preferably, on the same railcar 103.

A train-based wireless mesh network, shown in the drawings as reference number 107, consists of a powered PWG 102 typically located on a locomotive 108 (but which may be on any moving asset in the train consist), which is part of and manages a mesh network of a plurality of CMUs, each deployed on a railcar, wherein the locomotive and plurality of railcars form a train consist.

A railyard-based wireless mesh network, shown in the drawings as reference number 117, consists of one or more land-based, powered PWGs deployed at strategic locations in a railyard. The PWGs form a mesh network which includes one or more CMUs, each deployed on a railcar, and one or more mobile PWGs, each deployed on a powered asset, such as a locomotive, and may optionally include one or more WSNs located on railcars. Under certain circumstances, individual WSNs located on railcars may directly join the railyard-based (or train-based) mesh network, bypassing the CMU on the railcar, by directly communicating with the PWGs located in the railyard. The locomotives and railcars in the railyard-based mesh network are not associated with a train consist, but instead the PWGs, CMUs and, optionally, WSNs located on the railcar are nodes in the railyard-based mesh network.

Building off of the IEC 62591 international wireless standard as well as the ISA100.11, a standard from the International Society of Automation, the railyard- and train-based wireless mesh network architectures are developed to these standards.

A managed railyard is defined as a railyard having a railyard-based mesh network overlaid thereon.

The discussion which follows describes the system in the context of a railcar, however, it will be understood by one of skill in the art that the same methods are applicable to any railroad vehicle or asset. It should also be noted that the definitions above are not meant to be exclusive, in that defined components may have additional components or features not included in the definition. Furthermore, while the description which follows features a railcar with two trucks (or bogies), it is applicable to any configuration with more or less trucks or axles.

DETAILED DESCRIPTION OF THE INVENTION

It is an object of the present invention to provide a train consist management system, where a railyard-based mesh network is overlaid on a railyard, and which includes one or more PWGs present in the railyard which act as communication points and aggregators of data generated and transmitted by the mesh networks of each railcar in the railyard. In addition, the PWGs in the railyard manage train consists and perform analysis of data from multiple monitored railcars and systems. When a railcar is not within a managed railyard, the same data transmission and analysis can be performed in the presence of a powered wireless gateway installed on a locomotive or other moving asset.

The present invention operates in an environment of a managed railyard, having a topology as shown in FIG. 1. Railcar 103 (shown as both 103(*a*) and 103(*c*) in FIG. 1) is typically equipped with multiple WSNs 104 placed at various positions on railcar 103. The positioning of individual WSNs 104 is dependent on the operational parameter(s) of the railcar 103 which are being monitored. CMU 101 is positioned on railcar 103 and forms a railcar-based mesh network 105 being managed by CMU 101 and having the WSNs 104 as nodes in the network. Preferably, CMUs 101 will be positioned and oriented in a consistent manner on each railcar 103. Also preferably, CMU 101 will be positioned toward one end of railcar 103 so as to be useful in determining the orientation of the car within the train consist and at any location within the railyard. Optionally, railcar 103 may have only a CMU 101, and no WSNs 104, shown as 103(*b*) in FIG. 1 in which case there will be no railcar-based mesh network associated with that railcar.

Locomotive 108 is equipped with a PWG 102. PWG 102 also controls a train-based wireless mesh network 107 which is managed by PWG 102 and has CMUs 101 on each railcar in the train as nodes.

A railcar 103(*d*) not having a communication management unit 101 or WSNs 104 is considered an unmanaged railcar and is outside of the train-based mesh network 107.

Figure 2:
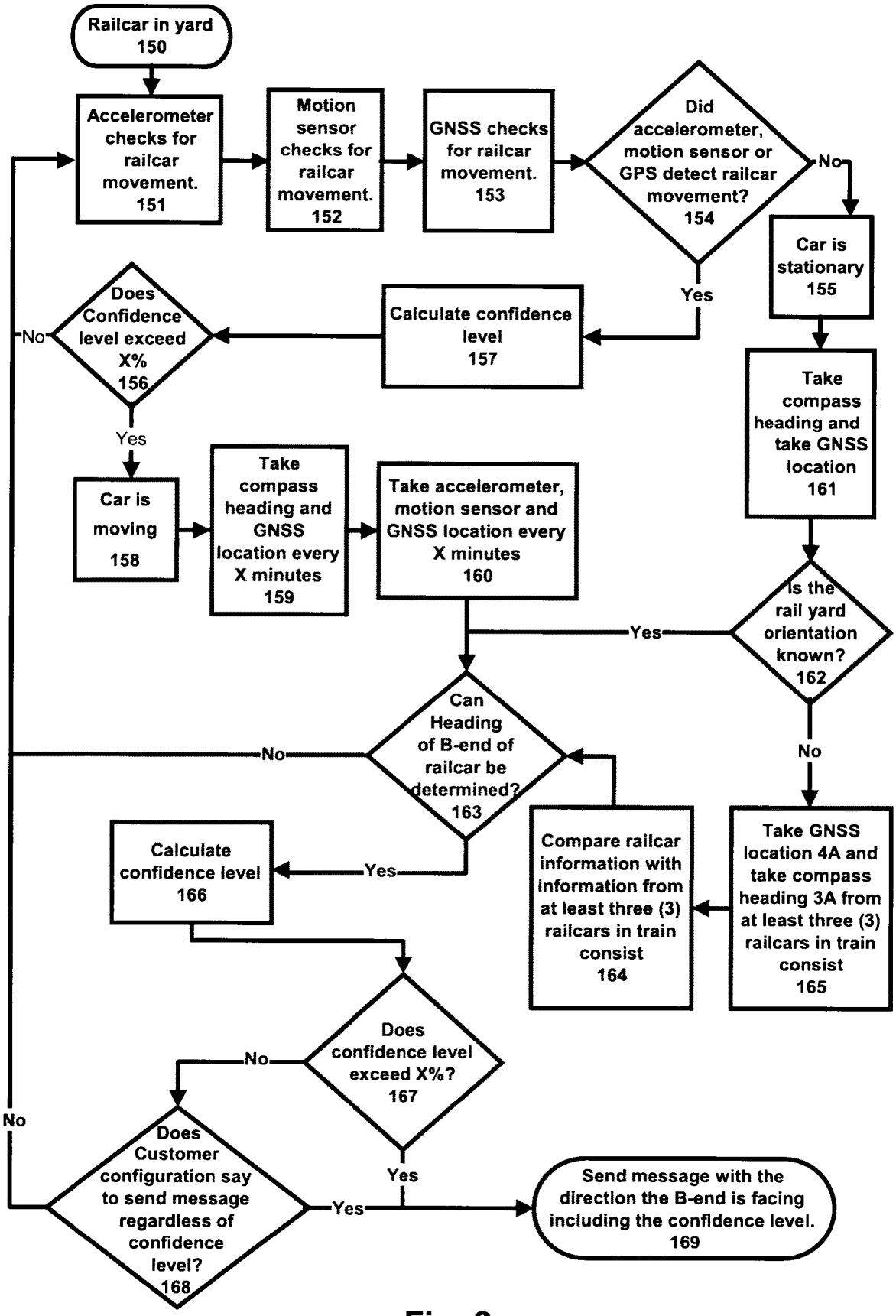
FIG. 2 is a flowchart illustrating a method of determining the location and orientation of a railcar in a railyard in relation to the rail.
Figure 3:
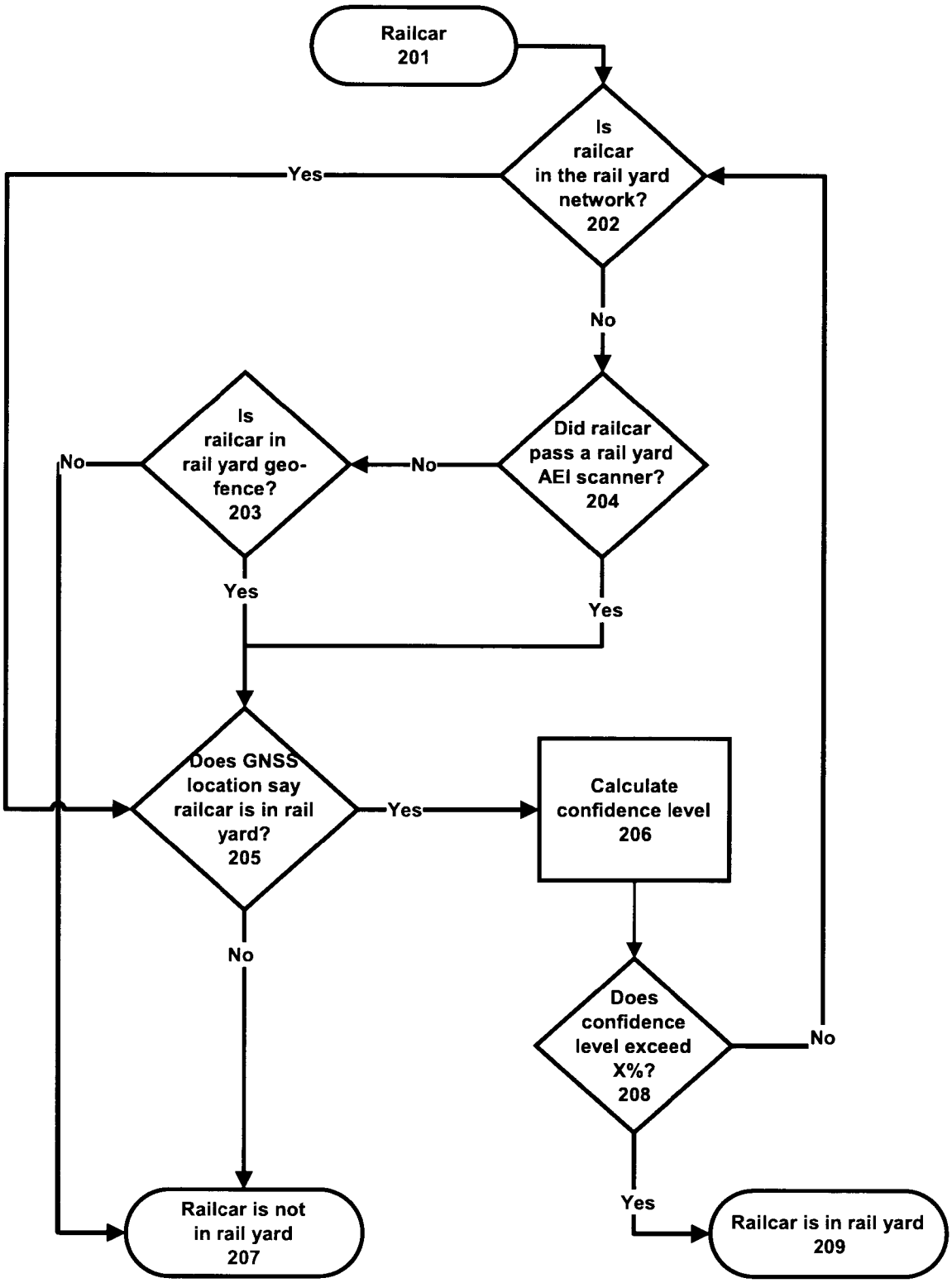
FIG. 3 is a flowchart illustrating a method of determining whether a railcar is in a railyard.

The present invention also relates to a method of monitoring a railyard wherein, the location and orientation of the railcar within the railyard is determined by the method shown in FIG. 2, the presence of a railcar 103(*a*) or 103(*b*) within the railyard is determined by the method shown in FIG. 3, and the building of a train consist proceeds as shown in FIG. 4.

The order of a railcar in the train consist, the orientation of the railcars and/or the location of the railcar in the railyard may be determined via several methods, discussed below. The orientation of a railcar in the train consist is a critical element in the train consist. As is known in the industry, the ends of a railcar are identified as either "A" or "B". Readings from a magnetometer or electronic compass and an accelerometer can be used to identify the orientation of the railcar. Additionally, orientation may be determined from the placement of system components on the railcar.

FIG. 2 is a flowchart showing the method of determining the location and orientation of a railcar within a railyard. The method makes the following assumptions:

- CMUs are installed in a known location and with a known orientation on each railcar.
- There can be one or many CMUs in the railyard.
- The boundaries and orientation of the railyard with respect to magnetic North is known by geo-fences and historical data.
- Time-stamps are associated with all sensor events.
- The orientation of a railcar in a known railyard can be used rather than the position of a device with a compass that is installed on a railcar.

The method starts with the assumption at 150 that the railcar is in the railyard. At 151, 152 and 153 it is determined whether or not the railcar is moving through use of an accelerometer, a motion sensor and/or a GNSS respectively.

At decision point 154, if motion was detected control proceeds to 157 where a confidence level is calculated and, at decision point 156, it is determined if the calculated confidence level exceeds the required threshold. The confidence level calculated at 157 is the likelihood that the railcar is actually moving. If, at decision point 156 the threshold is not met or exceeded, control proceeds back to the beginning of the method where various sensors are checked for movement. If it is determined that the railcar is in motion, at 158 a compass heading and GNSS location are periodically obtained at 159 and at 160. Readings from the accelerometer and motion sensor are also periodically obtained. At decision point 163 it is determined if the heading of the B-end of the railcar can be determined. If it can, a confidence level is calculated at 166 and, at decision point 167 it is determined if the confidence level exceeds the required threshold. If the threshold is exceeded, a message is sent with a direction the B-end the railcar is facing including the confidence level at 169. If the confidence level does not exceed the threshold at decision point 167, then control returns to the beginning of the method where movement is detected at 151, 152 and 153. At decision point 168, the user may optionally configure the system to send the message regardless of the confidence level, in which case the message is sent at 169.

If, at decision point 154 it is determined that no motion was sensed, the railcar is declared as being stationary at 155 and a compass heading and GNSS location are obtained at 161. At decision point 162 it is determined if the orientation of the railyard is known. If it is unknown, control proceeds to 165 where the GNSS location and compass headings from at least 3 railcars in the train consist are obtained. At 164, the compass heading and GNSS location from the railcar in question is compared to the readings obtained at 165 from at least three other railcars. At decision point 163 it is determined whether or not the heading of the B-end of the railcar can be determined, and, if not, control proceeds as described above. At decision point 162, if the orientation of the railcar is not known, then control proceeds directly to decision point 163 and thereafter proceeds as above.

FIG. 3 is a flow chart showing a method of determining whether or not a railcar is inside of a railyard. In this case, the method assumes that the railyard is a managed railyard. The method starts at 201 with the railcar. At decision point 202 it is determined if the railcar is a member of the railyard-based wireless mesh network 117. If it is, control proceeds to decision point 205 where it is determined whether or not the location of the railcar as reported by GNSS is consistent with the railcar being in the railyard. If it is, a confidence level that the railcar is actually in the railyard is calculated at 206.

At decision point 208, it is determined if the confidence level exceeds the required threshold for making a determination that the railcar is within the railyard. If the threshold is exceeded, control proceeds to 209 where it is determined that the railcar is in the railyard. If the confidence level is not exceeded, control returns back to decision point 202.

If, at decision point 205, the location of the railcar as reported by GNSS is not consistent with the railcar being in the railyard, control proceeds to 207 and the conclusion is drawn that the railcar is not in the railyard.

If the railcar is not a member of the railyard—based wireless mesh network 117, control proceeds to decision point 204, where it is determined if the railcar passed an AEI scanner. If the railcar has passed an AEI scanner, control proceeds to decision point 205 and proceeds as above. If, at decision point 204 the railcar has not passed an AEI scanner, it is determined at decision point 203 if the railcar is within a geo-fence defining the boundaries of the railyard. If it is determined that the railcar is within the railyard's defined geo-fence, control proceeds to decision point 205 and proceeds as described above. If, at decision point 203 it is determined that the railcar is external to the railyard's defined geo-fence, it is determined that the railcar is not in the railyard at 207.

A collection of links creates a train consist as referenced in FIG. 4. A train consist is built one link at a time. The linking of railcars and links of railcars is a critical part of this process and can be determined by one or more methods, which can be used stand-alone or in combination to provide a level of probability that two or more railcars are linked, or that two or more links of railcars are linked. The confidence level of the order of the railcars in a train consist is increased if more than one method is used. The sensor readings and process results are associated to an asset, a component of the asset, a phenomenon, and time. The information is stored so that analysis can be performed on both real-time and historical datasets.

Figure 13:
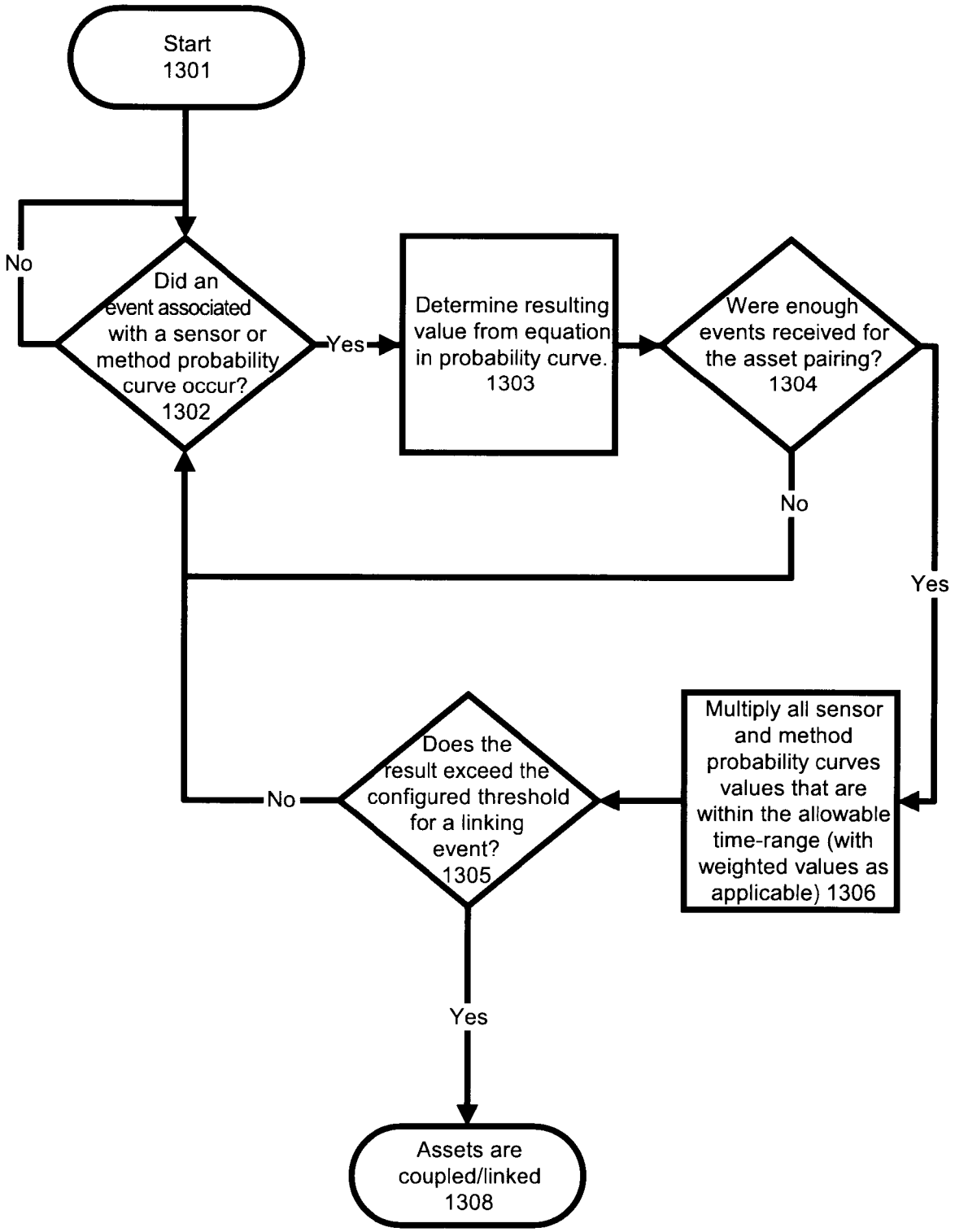
FIG. 13 is a flow chart showing the process for determining if a coupling event has occurred.

FIG. 13 is a flowchart showing the process for verifying whether two or more railcars have been coupled, or whether two or more links have been coupled. The process starts at 1301 and, at decision point 1302, it is determined if an event has occurred for which a probability curve exists (i.e., an event that may be relevant in determining coupling). If not, control returns back to decision point 1302. If an event of interest was received, the value of the probability for that event is retrieved from the relevant probability curve at 1303. At decision point 1304, it is decided if enough events have occurred such that a coupling can be evaluated. If not, control returns to the decision point 1302. If enough events have occurred, the probabilities from the probability curves for each of the events are retrieved at 1306 and multiplied together to create an overall probability. At decision point 1305 it is determined if the overall probability exceeds the predetermined threshold necessary to declare that a coupling has positively occurred. If not, control returns to decision point 1302. If so, then the coupling event is declared to have occurred at 1308.

FIG. 4 shows the formation of a train consist built of links of railcars. In FIG. 4(*a*), railcar B impacts railcar A and forms link 401. Likewise, railcar D impacts railcar C and forms link 402. In FIG. 4(*b*), railcar C impacts railcar B to form larger link 403 shown in FIG. 4(*c*). In FIG. 4(*d*) a single railcar E impacts railcar D to form link 404, consisting of railcars A through E, shown in FIG. 4(*e*).

CMUs 101 primarily provide data upstream to determine the presence of railcars in a railyard, the location and orientation of railcars in a railyard (FIG. 2), a connecting or linking of railcars as they are prepared to be part of a train consist (FIG. 4), an order of railcars in a train consist, a validation of railcars in a train consist and a direction of travel of a train consist. Additionally, the CMU has an optional means for monitoring the output from a variety of sensors (both internal to the CMU and in WSNs which are in communication with the CMU) as well as attached directly to a railcar and determining the behavior and condition of the railcar and its various components, based on an analysis of the data. The sensors collect, store, analyze and process data, which is then transmitted to the CMU for further transmission to a PWG, where an engineer, control point or automated system can act on the data, for transmission to a remote railroad operations center, or for processing and analysis to build alerts, events or reports.

The CMU is capable of collecting data from each integrated sensor as well as from WSNs and performing higher-level analysis of the data by applying heuristics and statistical models to data, events and alerts collected from a plurality of WSNs, to determine location, speed, heading, condition and more of a railcar. During such data analysis, heuristics may be applied to determine potential linking of railcars based on statistical models and empirical data. The CMU also is capable of communicating both the data and the results of any analysis to another system remote from the railcar, via any one of a number of communication protocols.

A PWG may be located, for example, on a locomotive, in a railyard or at an off-train location at a remote railroad operations center. The PWG may also be able to perform higher-level analysis of the condition of an entire train consist by applying heuristics and statistical models to data, events and alerts collected from a plurality of CMUs, located on different railcars in the train. The analysis of the data collected can be carried out at any one of a plurality of different event engines distributed among the various components in the present invention, including the sensor units, CMU, train-based or land-based PWGs, or other land-based stations. The event engine is used to determine state changes and actions to perform on the device from a plurality of inputs internal or external of the system. The logic used to determine an outcome is based on a set of rules which can be configured and updated remotely.

Figure 5:
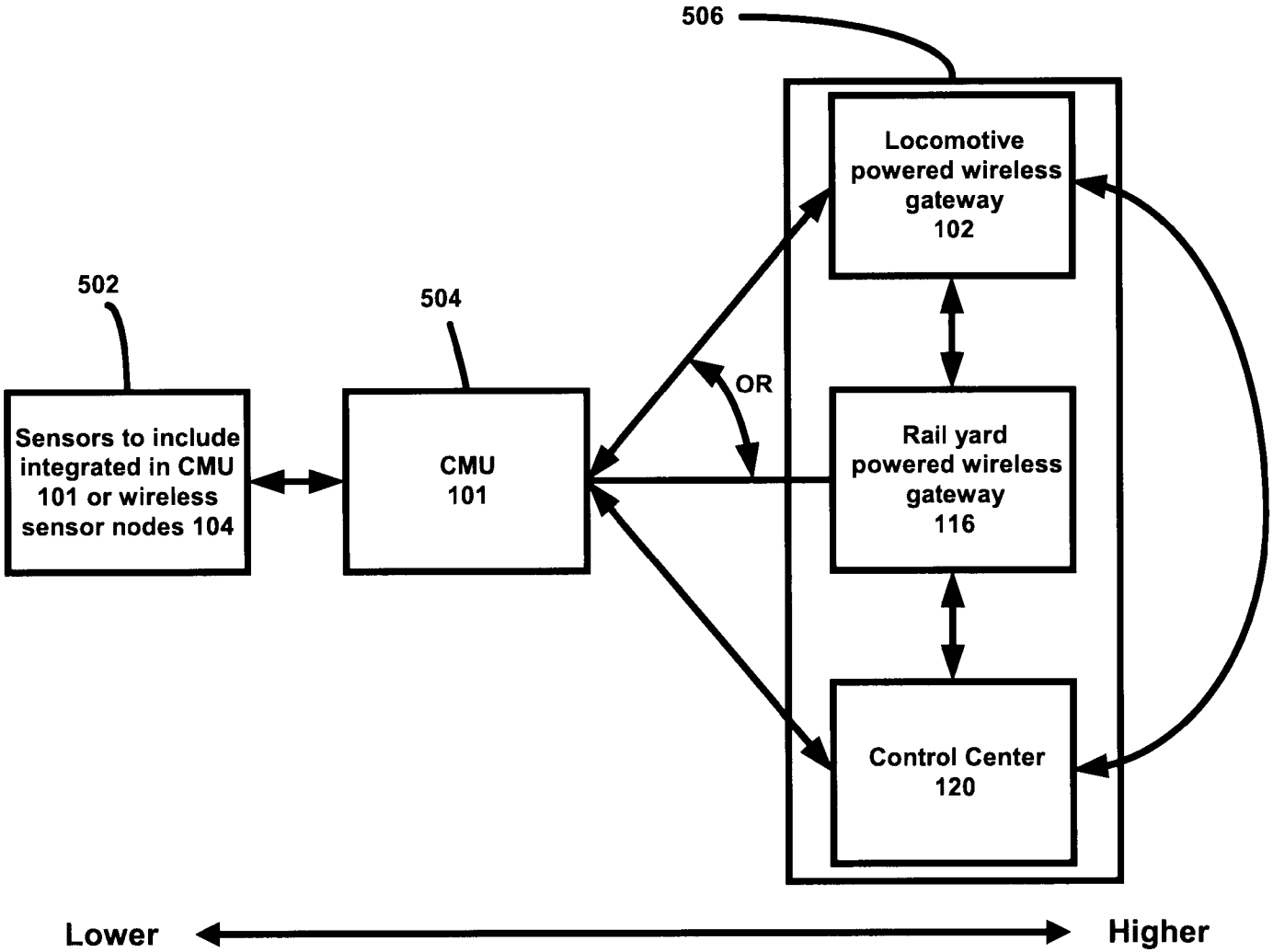
FIG. 5 is a diagram illustrating how data flows from a wireless sensor node, a communication management unit, a powered wireless gateway and to a control center.

FIG. 5 shows a method for managing data as it flows from sensors on WSNs 104 or the CMU 101 and thereafter to various higher-level destinations. The following assumptions are made:

- A method of data analysis is carried out by event engines at each level.
- Logic analysis is pushed out to the lowest level possible to an enable more effective management of bandwidth, power consumption and latency.
- Events are only published upstream when necessary.
- Filtering and analysis of data and events is conducted at each level.
- CMUs, PWGs and servers (within the control center) can utilize sensor fusion to better determine the state of larger systems that share events from these different data sources.

The lowest level of processing 502 includes the optional WSNs 104 disposed on each railcar 103(*a*) or 103(*b*), and sensors which may be integrated into CMUs 101 on each railcar. Data collected at lowest level 502 is analyzed by on-board processors included in each WSN 104 or CMU 101 to determine which data can be discarded and which data needs to be sent to the next higher processing level 504. The next highest processing level 504 includes a CMU 101 on each railcar. CMU 101 on each railcar is capable of making decisions which may require data from multiple WSNs 104 on the railcar. CMU 101 can also determine, based upon this analysis, what data needs to be sent to the highest processing level 506. The highest processing level 506 includes a PWG 102 located on the locomotive, land-based PWGs 116 disposed in the railyard and control center. PWG 102 in the locomotive is capable of making decisions which require information from multiple CMUs 101 or from multiple WSNs 104 on each railcar (i.e., train consist-wide statuses). If a railcar 103(*a*) or 103(*b*) is within the confines of a railyard, messages from CMU 101 may be sent to a PWG 116 located in the railyard. This would be a land-based stationary PWG 116. CMU 101 on each railcar at level 506 may also send messages directly to control center. At the highest level of processing, information may be shared between a locomotive-based PWG 102 and railyard-based PWG 116 and control center. Box 506 represents the highest level of processing and decisions at this level typically represent status information regarding an entire train consist or railyard.

The various levels of processing combine to create a distributed inference engine in which each level of processing can draw inferences requiring data from that level and/or data which has been provided by lower levels of processing and moved to higher levels. As an example, verifying a coupling event requires data from at least two railcars (e.g., detect impact data and location data from each railcar being coupled). As such, the coupling event must be made at the highest level of processing after receiving data from each railcar. In this case, the highest level of processing is represented by 506 in FIG. 5, which would be a node in the railyard-based wireless mesh network.

Figure 6:
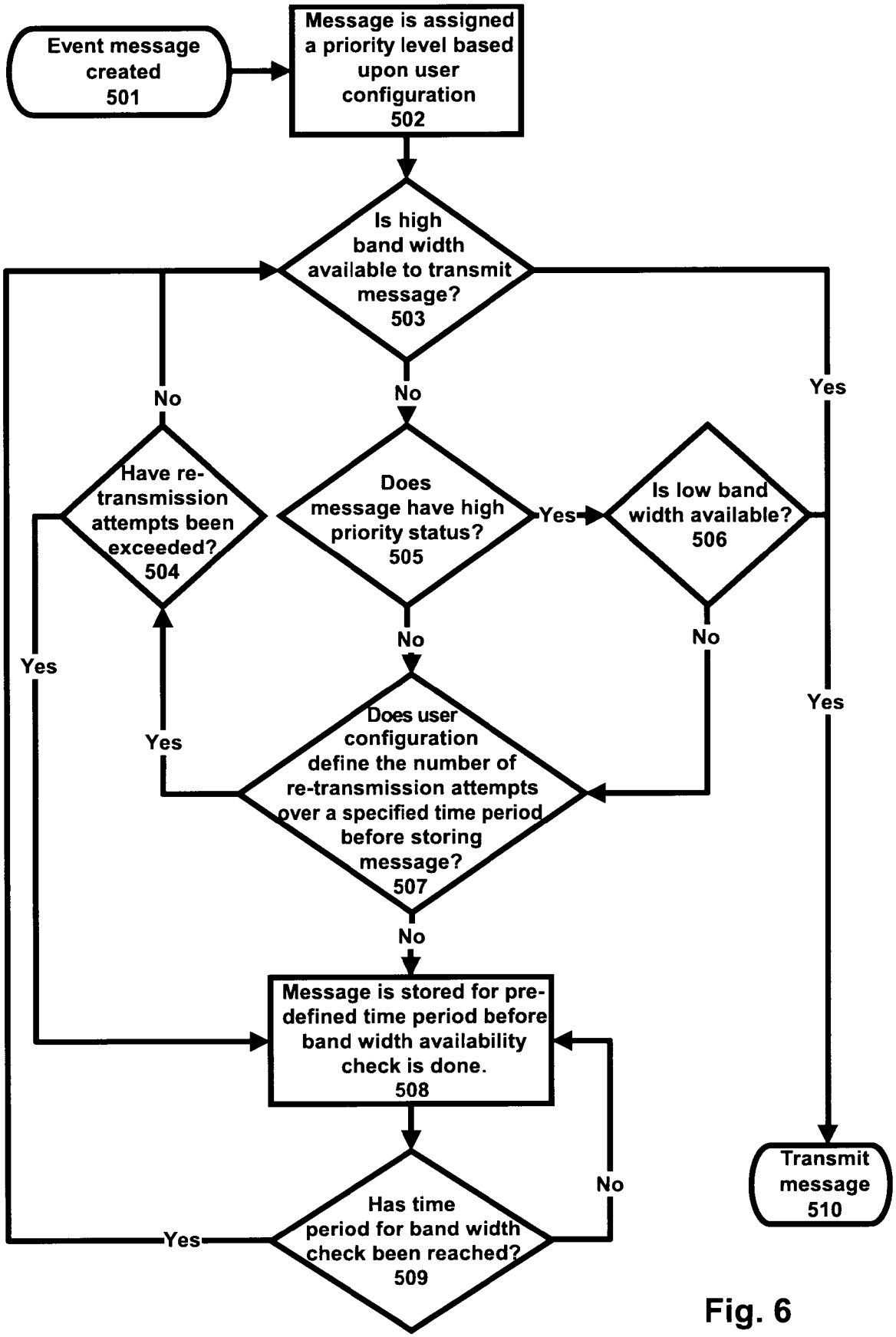
FIG. 6 is a flowchart illustrating how messages are transmitted based on message priority.

FIG. 6 is a flow chart showing the method of transmitting messages, based on priority, from the lower levels of processing 502 to the higher levels of processing 504 and 506, shown in FIG. 5. The method starts at 501 where an event message is created. At 502 the message is assigned a priority level which is based on a user configuration and, at decision point 503 it is determined if high bandwidth is available to transmit the message. If high bandwidth is available, control proceeds to 510, where the message is transmitted. If high bandwidth is not available, at decision point 505 it is determined if the message has a high priority status. If the message is high priority, control proceeds to decision point 506 where it is determined if there is low bandwidth available. If low bandwidth is available, the message is transmitted at 510. If the low bandwidth is not available or if the message does not have high priority status, control proceeds to decision point 507 where it is determined if the user configuration defines a number of re-transmission attempts over a specified period of time. If so, then control proceeds to decision point 504 where it is determined if the required number of attempts have been exceeded, and if not, control proceeds to decision point 503 and proceeds as described above. If the number of re-transmission attempts has been exceeded, or if the user has not configured the re-transmission option, then the message is stored for a predefined time period before a bandwidth availability check is performed at 508. At decision point 509 it is determined if the bandwidth check time period has been reached, and if so, control proceeds to decision point 503 and proceeds as described above. If the time period has not been reached then control loops back and the message is stored until the bandwidth check is to be performed again.

The following types of methods can be used to determine the linking (or unlinking) of two or more railcars or two or more links, as shown in FIG. 4.

Motion—If an accelerometer, and or a motion sensor and or GNSS indicate motion on two or more railcars, the time stamps are compared to determine the likelihood that two or more railcars are linked.

Speed and Heading—When two or more railcars are traveling at the same speed and on the same heading then they are considered linked.

Network Signal Strength—A link can be determined by comparing the signal strength across two or more railcars and comparing it to the signal strength of other railcars in the railyard-based wireless mesh network. The signal strength is compared to known adjacent railcars, where the railcars are considered linked. The wireless network connection is established when two or more railcars each have installed a CMU 101 that has the ability to communicate with the wireless network. Each CMU 101 has a measurable signal strength where both the presence of the signal and the strength of the signal can be used to determine if two or more railcars are linked.

Impacts—An impact with time stamp is generated when two or more railcars are coupled. The time stamp across two or more railcars is compared to determine which railcars have time stamps within a specific time period, which is then used to determine if the railcars are linked. Additionally, during an impact, there is a positive and negative response created, wherein the positive and negative wave profiles are compared and if they are the same or similar the railcars are considered linked.

Location—If two or more railcars have location readings within proximity to the others, it can be assumed they are linked. The confidence level of this type of linking depends upon the complexity of the railyard. Location information may be obtained from a GNSS.

Spline Curve Fit—Knowing at least three railcars in a train consist, utilize location in conjunction with spline curve fit between railcars in a string. As the train consist is assembled, a best fit curve can be applied to the railcars currently in the train consist. Best fit curve must be within constraints of railroad track geometry. This curve can be used to determine if a railcar is incorrectly marked as not within the train consist, based on location position and proximity to the spline.

Compass Heading—Knowing at least three railcars in a train consist, utilize location in conjunction with angle of compass heading between adjacent railcars (FIG. 8)—As the train consist is assembled, angle variation between adjacent railcars can be used to determine potential linked railcars. Angle must be within constraints of railroad track geometry. The difference in angle between railcars can be used to determine if a railcar is incorrectly marked as not within the train consist, based on location position and angle values that match other adjacent railcars within the same known train consist.

Brake Events—During a braking event, a pressure change occurs to modify the braking state on each railcar. This event of a pressure change will be perceived by each connected railcar in series from the locomotive to the last connected railcar. The time of this event is used to determine connected railcar order in the train consist.

One example of this would be the brake test. A brake test must occur before a train consist can leave a railyard. In this case, brake lines in connected railcars will be pressurized to a standard pressure. This ensures the brakes are released. During a brake test, a sudden drop in pressure occurs to actuate the brakes on each railcar. This event of a sudden pressure drop will be perceived by each connected railcar in series from the locomotive to the last connected railcar. The time of this event is used to determine connected railcar order in the train consist.

AEI Tags—If two or more railcars are scanned by the same AEI (Automatic Equipment Identification) reader, use the time of the scan, the time difference or offset between the scan of each railcar and the speed of each railcar to determine if the railcars are linked.

When an "event" occurs, either asynchronously triggered by external phenomenon (e.g. motion starts) or on a timed basis, the event is recorded and transmitted to a CMU or PWG within the railyard or train consist. The sensors are installed on different components of an asset, recording the asset, time, and details of the event. Some examples of sensors and methods are listed below (but not limited to):

- Asset impact—measured in g-force
- Railcar coupler impact—measured in g-force (this is a more specific form of asset impact)
- Asset GNSS location—latitude and longitude
- Asset speed and heading—measured in mph & direction of travel in degrees
- Brake line pressure change—measured in psi
- Asset AEI tag scan—presence of scan (true/false)

Figure 7:
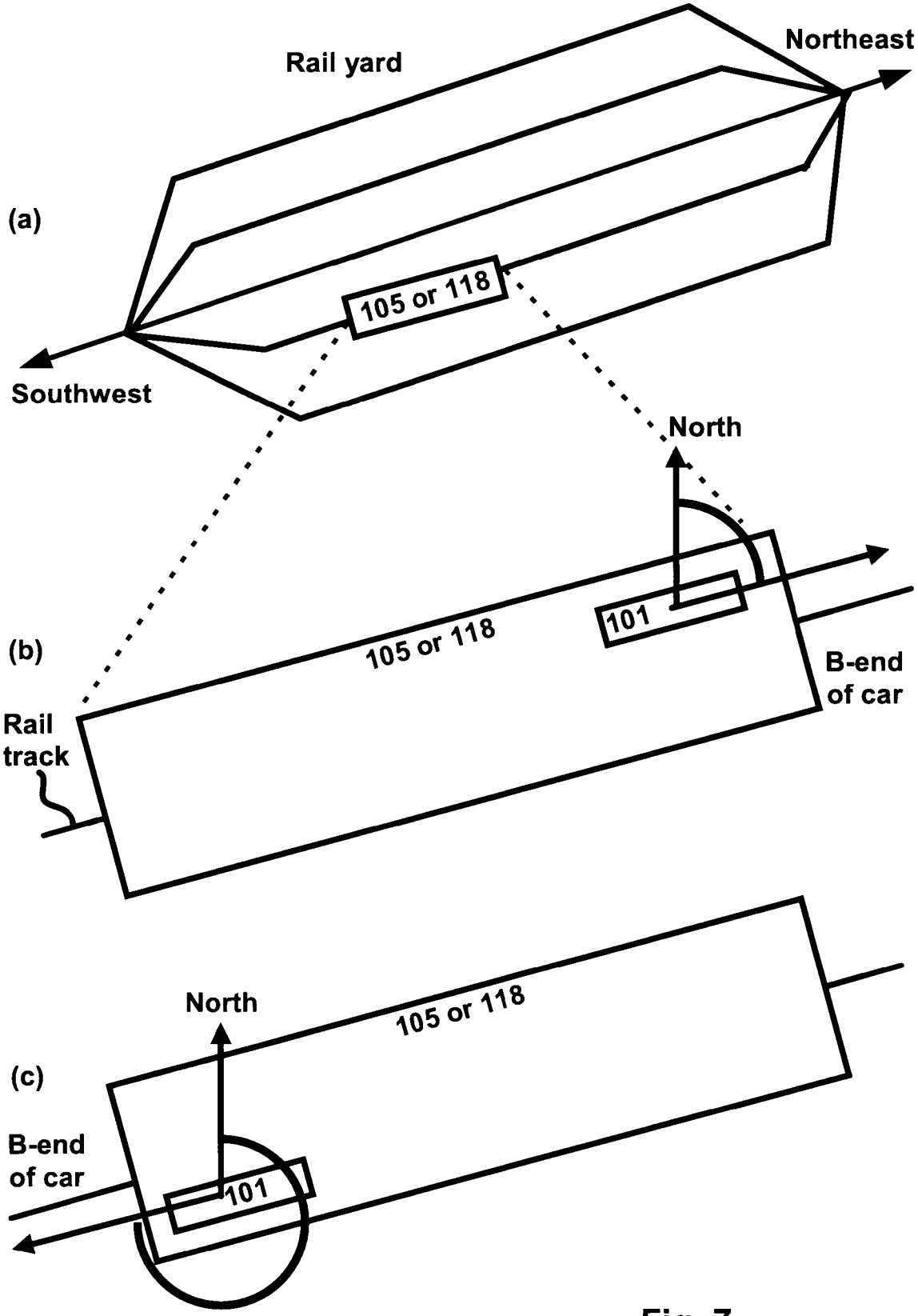
FIG. 7 is a diagram illustrating a railyard in which the direction of the railyard is known to be running southwest to northeast with enlargement of railcar showing how the B-end of a railcar with CMU installed can be determined based on the heading of the CMU compared to North.

FIG. 7 shows the method whereby the orientation of a railcar within a railyard is determined utilizing the on-board compass. This is a method that is performed in at 161, 159 and 165 of FIG. 2. This method makes several assumptions. First, the orientation of the railcar can be determined by a assuming that the CMU is installed in a known place and orientation on the railcar. It is also assumed that the orientation of the tracks within the railyard with respect to North are known, as shown in FIG. 7(*a*).

If the asset is in motion, the orientation of the railcar can be determined by comparing the changes in compass heading, or the lack thereof, over time parallel to the direction of travel as determined by the GNSS location updates. If the vector of the compass matches the vector created by the difference between two or more GNSS points, then the railcar is moving towards the B-end (if the CMU is installed/oriented in that way). This is shown in FIG. 7(*b*). If the vectors are opposite, then the railcar is moving towards the A-end. This is shown in FIG. 7(*c*).

If the asset is stationary, the compass and location can be used to compare to a known railyard layout and orientation stored within the system as shown at 162 of FIG. 2. The compass orientation and GNSS location will be used to compare against the railyard location and orientation to determine the railcar heading. If the asset is stationary and the railyard location is not known, then the orientation of a railcar in question can be compared with other assets in a known group of linked railcars. This is shown at 165 of FIG. 2.

Because the rail track can only curve at a small and defined rate, if three or more railcars are known as being linked, the variation in compass heading is small (when accounting for the 180 degree difference if facing opposite directions). If the asset in question is in close proximity to the railcars used for the baseline, or linked as part of the same train consist, a compass reading of the asset can be compared to the other assets to determine heading. As with other methods discussed herein, a confidence level can be assigned to the result, as shown at 166 and 167 of FIG. 2.

Figure 8:
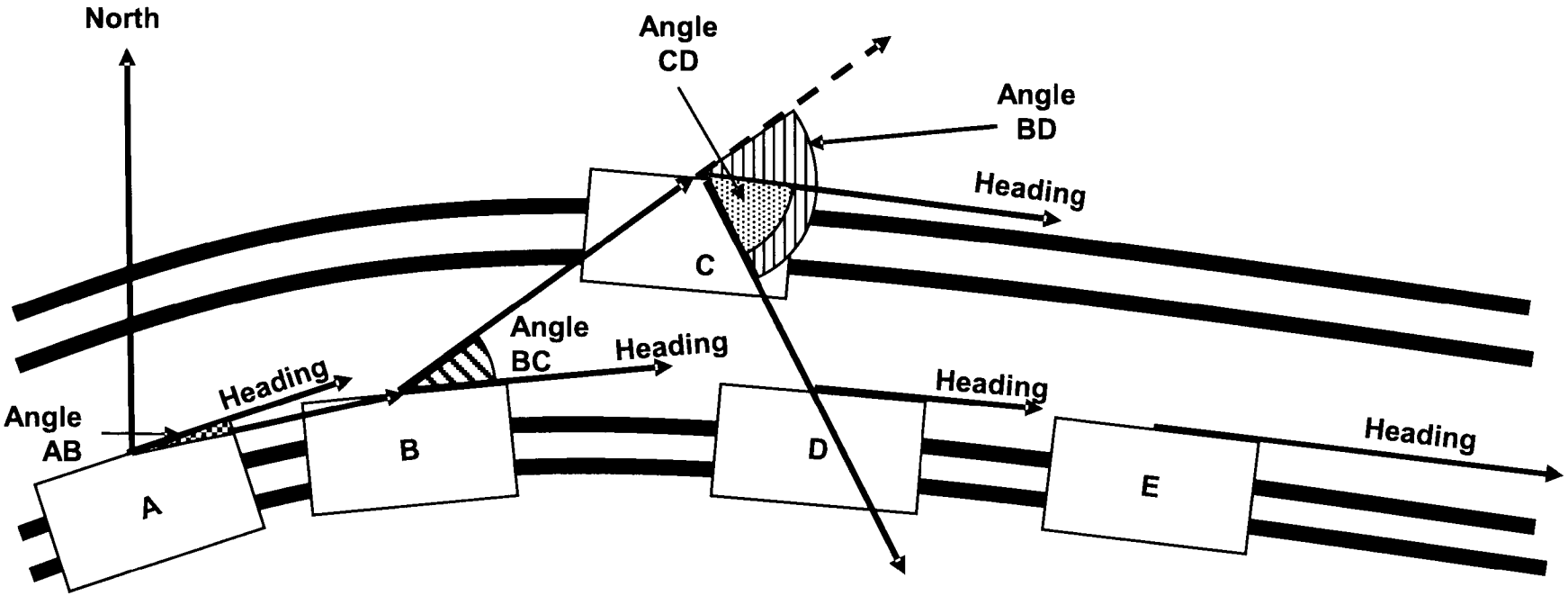
FIG. 8 is a diagram illustrating how to determine if two railcars are on the same rail track or not.

FIG. 8 shows a method to determine whether two railcars are on the same rail track or not. This method uses a spline curve fit to apply a best fit curve to the assets in the train consist. Any best fit curve that is not within the constraints of the railroad track geometry can indicate railcars on different tracks. As with previous methods, CMUs 101 on each railcar must be installed in a known location and orientation on the railcar. These locations are used to pair assets with the closest proximity to each other. The angle is calculated between railcars in close proximity (within the configurable distance of the maximum railcar gap) to determine the relative angle differences between railcars in close proximity. A GNSS reading of two railcars is used to determine the vector between each. This vector direction is compared to the compass heading of the railcar (against North). When angles between the GNSS vector and the compass heading are small, then the likelihood of the assets being on the same track is very high. If a difference in vector between the GNSS vector and the compass is high, then it is unlikely that the assets are linked and on the same track. The difference in angles becomes worse as problems cascade down the track.

As an example, with reference to FIG. 8, if the angle between A and B is small these are likely linked. If the angle between B and C is large, then these are likely not linked. The angle between C and D is also high and are also not likely linked. The maximum angle threshold can be used to determine if assets are likely linked or not. In FIG. 8, angle AB is the angle of railcar A relative to railcar B, and an example of an angle within the bounds of "Z" degrees (i.e., degrees indicating that track geometry has not been violated). Angle BC is the angle of the heading of railcar B with respect to railcar C, and angle CD is the angle of railcar C with respect to railcar D. Angle BD represents the difference between angle BC and angle CD. If angle BD exceeds "Z" degrees then it can be determined that railcar C is on a different rack than railcars B and D. If not, then railcar C is likely on the same track as railcars B and D. The threshold "Z" degrees is determined by geometry of the rail tracks.

A statistical logic engine is used to determine the confidence level of various determinations that may be inferred from the data that is collected from each railcar, including, for example, which assets are linked. Conditional probability is used to combine several different inputs, of different phenomenon types and units of measure, to provide a single output based on the knowledge of those other events.

For each method, component, and phenomenon, a probability chart is supplied to determine the difference between events occurring on two separate assets. Depending on the method used, the X axis represents the difference between the events or data collected from sensors on two (or more) assets.

Figure 10:
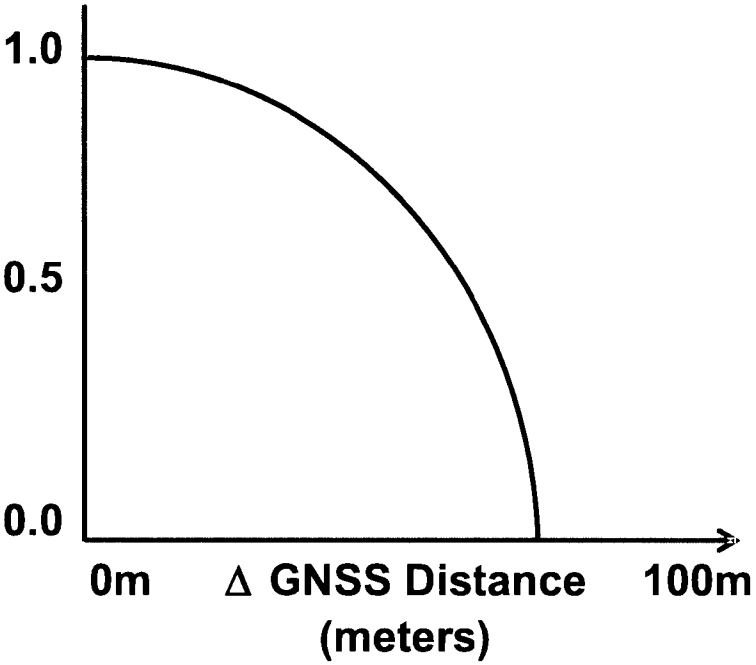
FIG. 10 shows examples of probability curves for two exemplary sensors.
Figure 10:
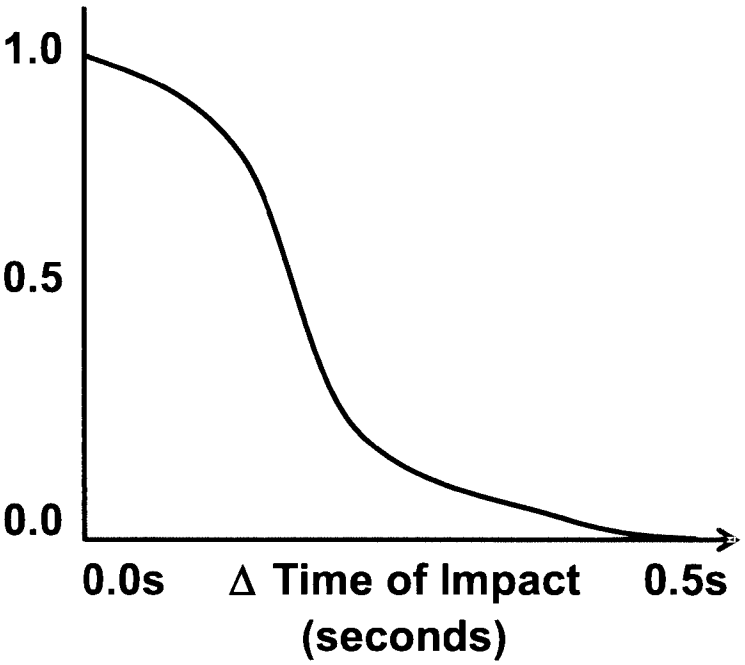

Each sensor (component and phenomenon pairing) and method has a probability curve showing the likelihood of a coupling event between two assets, wherein the X-axis can be based on the phenomenon that is measured, the time between events, or both (as a three-dimensional graph), as observed between two assets, and the Y-axis represents the probability of a coupling event. A coupling event is not guaranteed, to occur at any particular X measurement, but the measurement represents the opportunity for the coupling event to occur. A 1.0 on the graph indicates a coupling event is possible, for this sensor type or method. A 0.0 on the graph precludes a coupling event, invalidating all other sensor input curves in combination. Examples of probability charts are shown in FIG. 10, where FIG. 10(*a*) shows a probability curve for time between an impact event across two railcars and FIG. 10(*b*) shows a probability curve for the distance between two assets.

When events are received from multiple assets, the probability result is generated based on available data at the time. If the analysis of events across assets does not result in a coupling (or railcar linking) event, the events are saved, and can be reprocessed again when other events occur between the asset pair.

Figure 11:
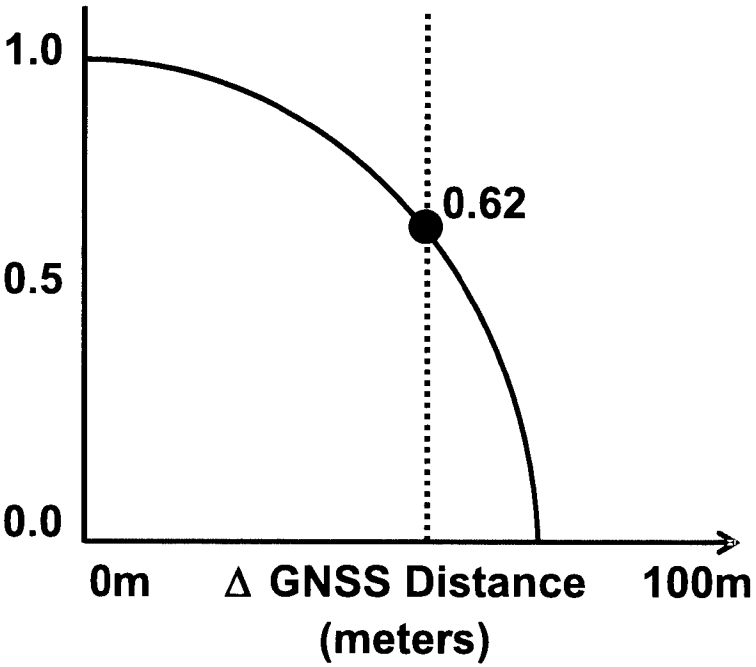
FIG. 11 is a specific example of the use of probability curves for determining the likelihood that two or more railcars are likely to be linked.
Figure 11:
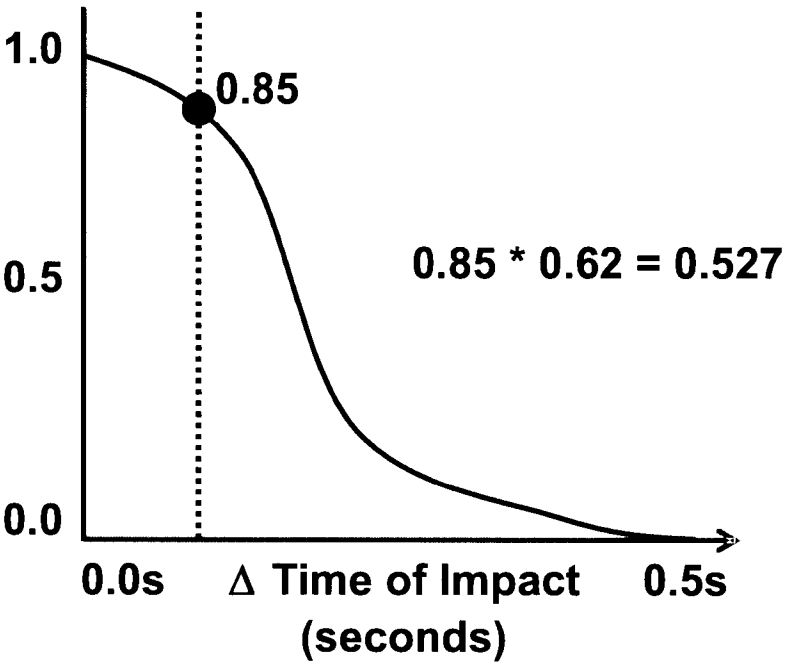

An example is shown in FIG. 11. FIG. 11(*a*) shows information is obtained regarding the impact times, showing the difference in time between two impacts, as measured on two railcars, is 0.19 seconds, resulting in an output value of 0.85, which represents an 85% probability that a linking has occurred. FIG. 11(*b*) shows a difference in distance between two railcars as 55 meters, resulting in an output value of 0.62, representing a 62% probability that a linking has occurred.

It is important to account for inaccuracies and imprecision in different sensors and methods when generating probability curves and assigning weighting to different methods. A curve should not have a probability level above the accuracy provided. Preferably, more accurate and precise methods are weighted higher than other methods.

In the simplest manifestation of the algorithm, the individual probabilities are multiplied together to get a combined probability, which, in this example, results in a 0.527 probability that a linking has occurred. This calculation does not utilize other sensor inputs, historical data, or apply a configurable weighted average, but all of these possibilities are within the scope of the invention.

The output value is compared to the user-defined threshold of what constitutes a linking event. If, for example, the threshold was set to 0.75, then this instance would be marked as "not linked", but an analysis can be executed again when new data is received for the assets in question.

There is a minimum threshold value which must be equaled or exceeded for the system to declare that a coupling event has occurred. The link state between an asset pair is defined as linked, not linked, or no data. Linked indicates that the calculated result is above the minimum threshold. Not linked indicates a calculation was executed, but fell below the minimum threshold—these asset pairings can be re-calculated when new event data is received for the assets and their respective components. No data indicates that there are no sensor readings for the asset pairing in question In addition to the pre-defined probability curves, historical metrics can be used for the same X and Y graphs, to compare results against a histogram of instances and verified results. The sensor histograms can optionally be used in place of the pre-defined probability curves, or in combination with the pre-defined probability curves (multiply the two results together per sensor), to show a confidence interval in a valid asset-coupling result (and quantity of events). An example of this is shown in FIG. 12, wherein FIG. 12(*a*) shows an historical histogram for the difference in times of impact and FIG. 12(*b*) shows difference in distance.

Figure 12:
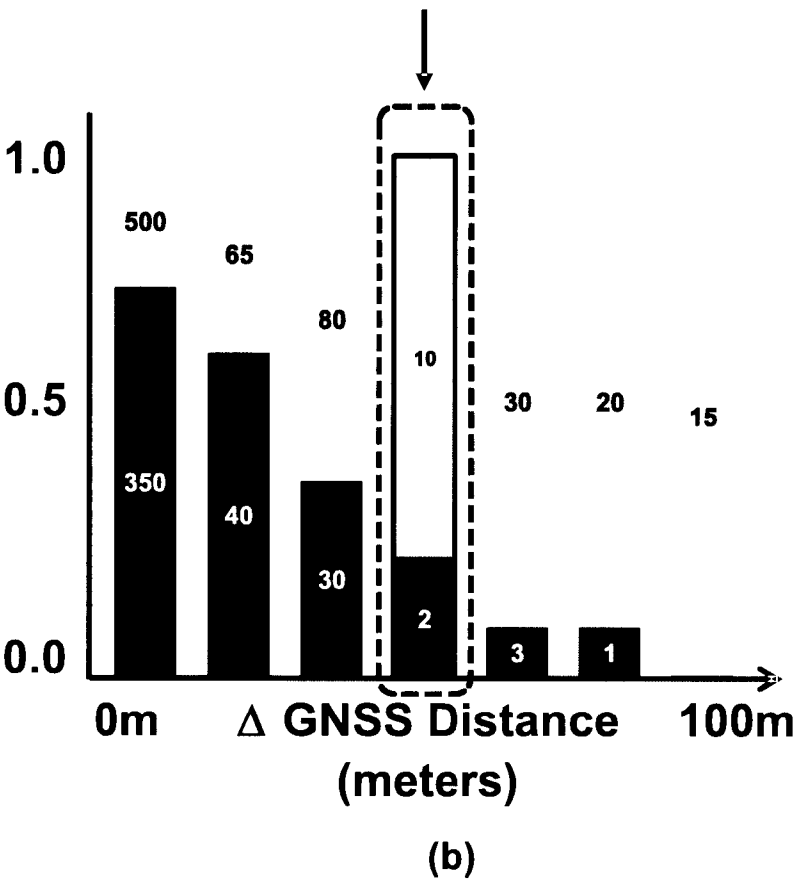
FIG. 12 shows examples of the use of historical data in lieu of probabilities to determine if two or more railcars are likely to be linked.
Figure 12:
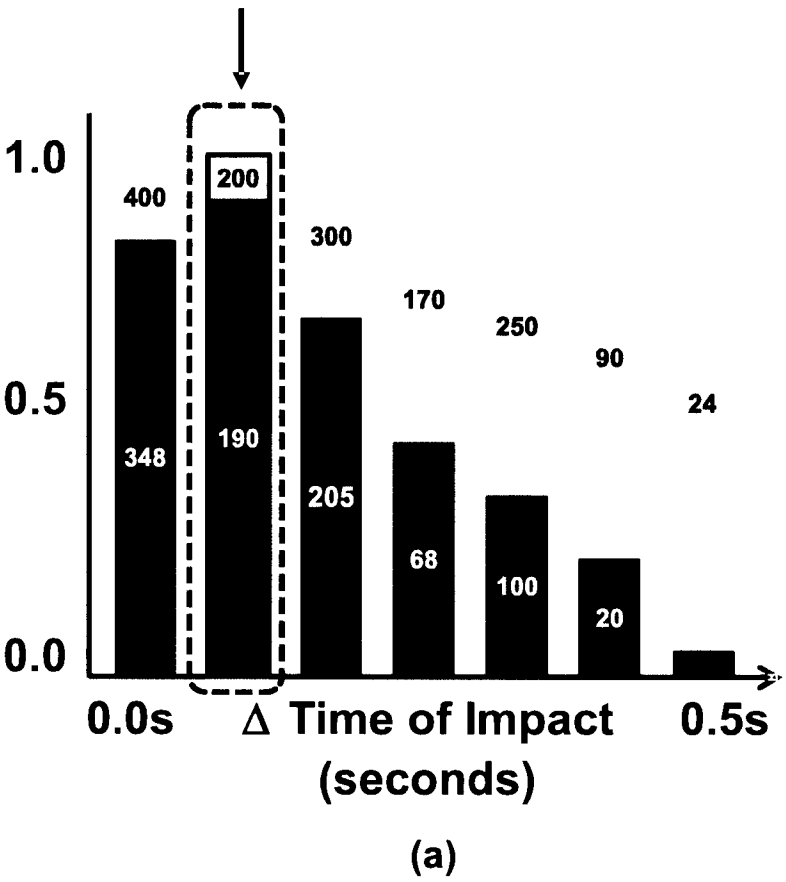

In another embodiment, a version of the histogram method shown in in FIG. 12 could use used to identify the accuracy of the asset link assumption itself. In other words, the histogram would show how often the result was correct (linked or not-linked) instead of only showing how often the X value resulted in an actual asset linking event.

Using this method, many different parameters and inputs can be used to generate the conditional probability of a linking event. As an example, two railcars are coupled together in a railyard, using a locomotive travelling at roughly 3 mph. An event is recorded on two separate railcar coupler accelerometers, both indicating peak impact events of 7 g's, within 1 millisecond of each other. A three-dimensional probability graph for a railcar coupler accelerometer uses the difference in time for the X axis, the difference in g-force as the Z axis, and the probability (0.0 to 1.0) as the result in the Y axis. After the event occurs, the PWG requests a location and speed of both assets, and the result is transmitted back to the PWG, indicating both assets are now stationary. The graph for difference in speed is used in combination with difference in time and the difference in g-forces to provide a secondary input, resulting in a value above the threshold used to mark the assets as being linked.

In one embodiment of the invention, the probability curves that associate to sensors and methods can be dynamically added, modified, and removed from the system. Machine learning algorithms can be used to automatically generate curves based on historical data when the final train manifests are provided.

In another embodiment, the system can be user-configurable. Method and sensor selections can be marked as enabled, ignored, or required. Additionally, the minimum number of distinct methods required to perform analysis (e.g. 2 or more needed or a result is not generated) can be specified.

In another embodiment, the system also has the capability of proving probability curves for each method, component, and phenomenon. A hierarchy of curves can exist for each sensor, mapping to more specific measurements, if available. For example, there may be an overall probability curve for impact, but if an asset has an impact sensor mounted on the coupler on a railcar, that more distinct probability curve for a coupler impact event can be applied in place of the higher-level impact curve. In the event that one asset has a more specific sensor mapping and the other has the higher-level mapping for the same phenomenon, the association between the assets can be configured to be allowed or rejected In another embodiment, the ability to provide a relative weighting metric for different methods is provided. For example, GNSS location between two linked railcars may be determined to be 4 times as important as compass heading to determine if a linking has occurred.

The system also has the ability to utilize historical data and a final result, provided externally, to validate linking events against known outcomes. This feedback is used to enhance probability curves and confidence intervals for different method, component, and phenomenon inputs. For example, if a railroad provides a final manifest for trains created, the actual data could be used as a check against predicted assumptions of railcar links, and mark each as valid or invalid.

The system also has a user-configurable window of time indicating when historical events are valid for analysis. The window indicates how long existing data can be used for analysis, based on each sensor type or method.

In another aspect of the invention, the system is capable of determining the order of railcars within a train consist. Any combination of the following can be used to determine the order of train.

Using historical data, and any combination of the "linking" algorithms previously described, the orientation and order of railcars within the train consist can be determined based on the time of the event, and the railcars involved for each link.

The system also utilizes physical constraints to accept or reject events that result in a link. For example, a single asset can only be linked to, at most, two other assets because there are physically only two couplers per railcar.

The time scan of the AEI tag plus elapsed time provides the position of a railcar within a train consist and optionally railcar heading and railcar speed, and can be used to validate the order and orientation of the railcars within the train consist as the train passes by the AEI reader (typically as the train is leaving the railyard).

The railcar's location can be used, however, direction of travel will not be determined and the confidence level will be low. The railcar's location plus the compass heading of the same railcar can be used, however the direction of travel will not be determined.

Using the "accordion effect" or push/pull, an accelerometer in each railcar's CMU records impact force as the railcar is pushed and pulled when the train moves. The impact force is recorded with a time stamp and offset and compared with other railcars in the train. Such movement creates a cascading events through the train, in which the event time stamps can be compared to determine in what order two or more railcars are moving. If the impacts and time stamps from two or more railcars show a time gap it is assumed there is a number of unmonitored railcar in the train consist.

The railyard-based wireless mesh network or the train-based wireless mesh network can determine if a railcar is in the network and if so, can compare the signal strength of the railcar with the signal strength of other railcars in the network. There is a low confidence level using this method.

There are multiple ways to validate the order of a train consist as it leaves a railyard. Data can be collected regarding location, speed, heading, movement, network signal strength and paths. Using these data points increases the confidence level regarding the order and orientation of the railcars within the train consist, when they are consistent with the pre-supposed configuration of the train consist.

In another aspect of the invention, the direction in which a train is traveling can be determined by employing one or more of the methods described below and as referenced in FIG. 7.

In aspects of the invention, the heading and orientation of a railcar can be determined. Regarding orientation, it is desirable to know whether the "A" end or the "B" end of a railcar is facing the head end of the train. This is important to railroads and to shippers to know the "A" and "B" end orientation because a railcar may be required to be positioned at its final destination such that the "A" or "B" end it facing a specific direction. In FIG. 2, the data from sensors and an algorithm to process the data provide a confidence level that the correct end of the railcar will be known. The CMU must be installed in a known orientation, for example, positioned on the B-end of railcar. The heading of the CMU is compared with North to determine the orientation of the railcar. Also, it is preferred that the direction of the railyard be known based on historical or geographic data such as rail track is in a Southwest to Northeast direction (See FIG. 7).

If the orientation of the railyard is not known, location data and compass heading of at least three linked railcars can be used to determine railcar heading by comparing compass heading of a railcar versus the direction of the track inferred by three or more linked railcars. If the orientation of at least one railcar is known, the heading of other railcars that are linked can be derived by comparing the compass heading of a railcar versus the known heading of the other linked railcars. If the orientation of at least one railcar is known, the heading of other railcars that are linked can be derived by comparing the timing of the impact during the coupling event as measured at the "A" and "B" of railcar. This impact information combined with the known orientation of one railcar will determine the orientation of the other railcar.

In another aspect of the invention, the system can be used to determine when assets are removed from a train consist or set of assets linked together. Similar to determining if the assets linked as described above, the removal of one or more assets can be inferred by the reciprocal event. Assets are assumed to be linked until otherwise determined by any number of the methods below:

Motion—If an accelerometer, and or a motion sensor and or GNSS indicate motion on two or more railcars with different values, the time stamps are compared to determine if the two or more railcars are unlinked.

Speed and Heading—When two or more railcars are not traveling at the same speed or on a different heading then they are considered unlinked.

Network Signal Strength—Unlinking can be determined by comparing the signal strength across two or more railcars and comparing it to the signal strength of other railcars in the railyard wireless mesh network. Where the signal strength is comparable to known unlinked railcars, the railcars are considered unlinked.

Location—If the location readings of two or more linked railcars are not within proximity to each other within a specified time interval, it is likely they are unlinked. The confidence level of this type of linking depends upon the complexity of the railyard.

Spline Curve Fit—Knowing at least three railcars in a train consist, location can be utilized in conjunction with spline curve fit between railcars in a string. A best fit curve can be applied to the assets currently in the train consist. Any best fit curve not within the constraints of railroad track geometry can indicate unlinked railcars.

Compass Angle—Knowing at least three railcars in a train consist, utilize location in conjunction with angle of compass heading between adjacent railcars (FIG. 7). Divergence in the angle variation between adjacent railcars can be used to determine potential un-linked railcars. In other words, the change in heading between consecutive railcars. Angle must be within constraints of railroad track geometry.

Brake Events—During a braking event, a pressure change occurs to modify the braking state on each railcar. This event of a pressure change will be perceived by each connected railcar in series from the locomotive to the last connected railcar. The time of this event is used to determine connected railcar order in the train consist. If there is no similar pressure change for a railcar, it is less probable to be part of the train consist.

AEI scans—If two or more railcars are scanned by the same AEI reader, the differences in the time of the scan, or offset between the scan of each railcar and the speed of each railcar can be utilized to determine if the railcars are not linked.

The system also utilizes physical constraints to further invalidate links between assets. For example, two railcars heading north in a railyard that only has tracks in the east/west direction invalidates the GNSS sensor method for the calculation.

Figure 9:
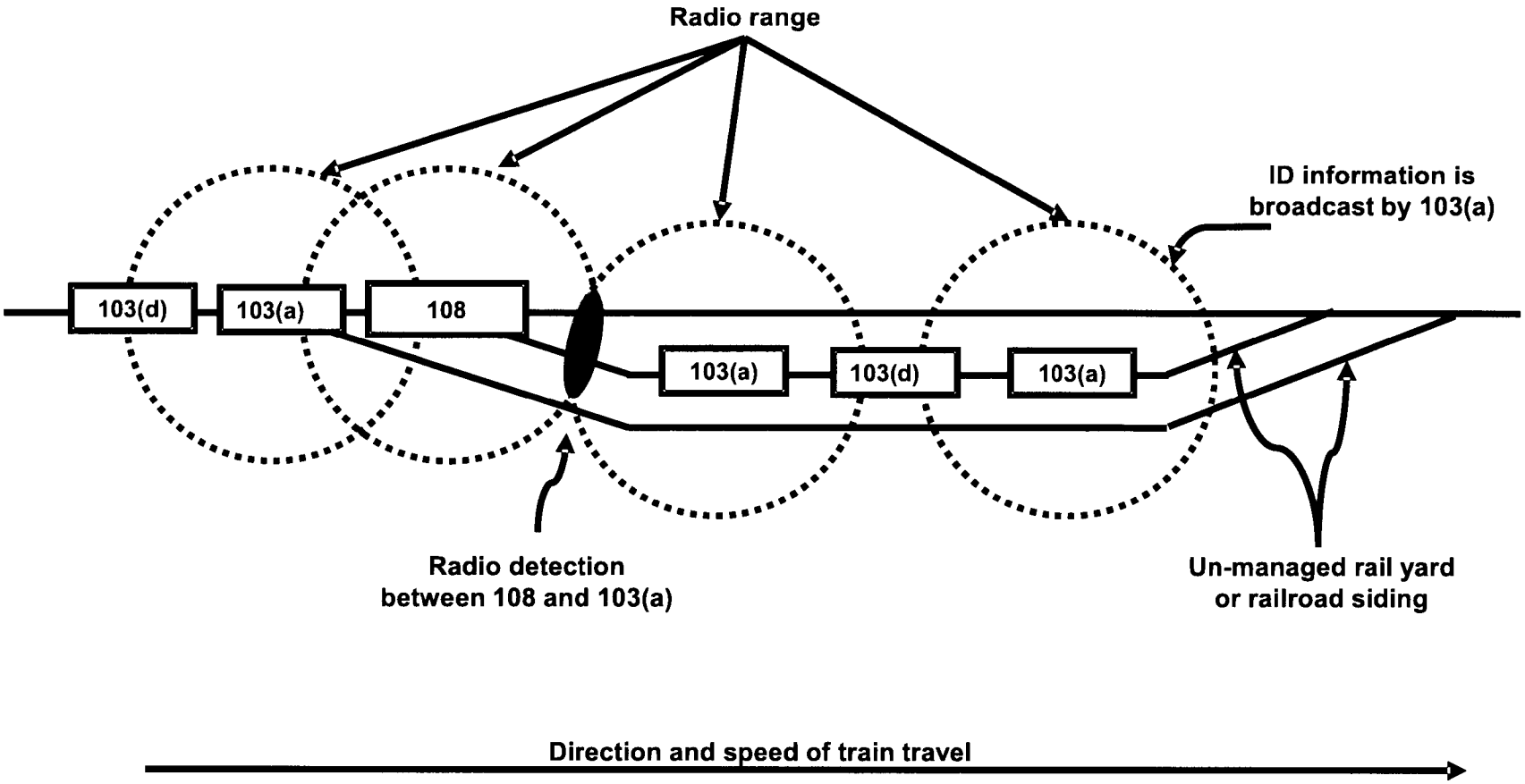
FIG. 9 is a diagram illustrating how monitored railcars, not within the presence of a PWG (either in a managed railyard or as part of a managed train consist) can be recognized by a passing locomotive upon which a powered wireless gateway is installed.

In another aspect of the invention, the presence of a dark railcar can be determined and reported. Dark railcars can be identified by a PWG on the locomotive directly, or the presence of a dark railcar can be passed through the wireless network from the CMU on one or more railcars in the train consist. This process is shown in FIG. 9.

Locomotive 108 has a PWG 102 and a railcar 103(*a*) or 103(*b*) has a CMU 101, which may be in a state that listens for radio broadcasts from other railcars 103(*a*) or 103(*b*) that are not connected to a train-based network, not connected to a managed railyard, or are sitting in an unmanaged railyard.

As locomotive 108 or a CMU 101 passes a railroad siding upon which at least one monitored railcar 103(*a*) or 103(*b*) are sitting, locomotive 108 will listen for radio broadcast identification information from monitored railcars 103(*a*) or 103(*b*). If a broadcast is detected, the PWG on locomotive 108 will transmit the identification information about the railcar 103(*a*) or 103(*b*) to the remote operations center.

In a second embodiment, a dark railcar will be in listen mode for other networks. When a railcar 103(*a*) or 103(*b*) within a train-based or yard-based wireless mesh network is in range proximity to the dark railcar, the dark railcar will hear "advertisements" from the railcar 103(*a*) or 103(*b*) in network. The dark railcar will reply to the advertisement from the railcar, with its identification and settings, which will be passed to the PWG 102. The PWG 102 will have the option of allowing the dark railcar to join the train-based or railyard-based wireless mesh network, passing the information down through the other CMUs to the dark railcar. If the dark railcar is blacklisted, it will not be allowed to join the train-based wireless mesh network. Once the railcar is in the network, it changes to the normal operating profile, and is no longer a dark railcar.

An important aspect of the invention is the capability of measuring certain parameters on vehicles in the train and relating the measurements or events to a common time base. This enables inferences to be made based on the relative measures. This same capability is important within railyards, to correlate events for train consist creation or facility operations. An example might include being able to sample vehicle acceleration on every railcar in the train consist and using the relative acceleration (or deceleration) to detect run in and run out at any point in the train. Another example is relating wheel impact events to individual track anomalies, where all wheels on one side of a train may detect it, and we want to associate all events to a single track feature. A railyard example would utilize this functionality to determine the cascading of coupling events as the force of impact translates through several railcars during train consist creation.

Assets within a railyard or train consist, which are managed, are synchronized to a precise network clock, with time accuracy synchronized across all devices. In the preferred embodiment of the invention, for example better than 1 millisecond time accuracy synchronization is used. This enables direct correlation of events across all assets.

In a train-based or railyard-based network, where a multitude of CMUs or WSNs having microcontrollers or microprocessors are used, to take a measurement or detect an event, clock drift becomes a limiting factor in the confidence placed on the time base of any measurement. In wired or permanently powered wireless systems with high bandwidth, regular synchronization of the clocks to a master time is an established practice. However, wireless, self-contained and self-powered CMUs and WSNs would use too much bandwidth and consume too much power to maintain the tight time synchronization needed to differentiate between certain types of events or provide a set of instantaneous measures from across the train. Clock drift becomes particularly limiting at temperature extremes or when the temperature changes rapidly over a relatively short period. It is further exacerbated when multiple discrete networks are used (a railcar-based mesh network connecting with a train-based mesh network for instance) and a mesh topology is employed versus a point-to-point network.

The present invention overcomes this constraint through the use of a very high accuracy network time base running over a time synchronized mesh network which is used to periodically (based on the desired accuracy) correct the microcontroller's timing mechanism to a predetermined accuracy. In the preferred embodiment of the invention, for example, 1 millisecond accuracy is desired. The system also has the ability to use a broadcast or scheduled event to trigger time-synchronized sampling across the entire train and/or railyard. CMUs are corrected to PWG time and WSNs are corrected to CMU time. This enables simultaneous sampling of data across all components (PWGs, CMUs, and WSNs) to within the predetermined accuracy, with no impact to network bandwidth capacity or power use.

We claim:

1. A system for managing assets in a railyard comprising:

one or more powered wireless gateways disposed in a railyard; and one or more railcar-based communication management units;

wherein said powered wireless gateways and said railcar-based communication management units form a railyard-based network; and wherein a computing device has access to said railyard-based network, said computing device running software configured to perform the functions of:

collecting first data from said railcar-based communication management units regarding events occurring on or the status of respective railcars;

drawing inferences from said first data regarding the state of said respective railcars; and reporting said inferences;

wherein at least one inference of said inferences is assigned a confidence level.

2. The system of claim 1, wherein said confidence level represents a probability that said at least one inference is true.

3. The system of claim 2, wherein said confidence level is a combination of probabilities from one or more of said events.

4. The system of claim 2, wherein said at least one inference is declared to be true when said confidence level exceeds a pre-defined value.

5. The system of claim 1, wherein said events include one or more of detected impacts, motion, acceleration, global navigation satellite system (GNSS) location, speed, compass heading, brake line pressure change and automatic equipment identification (AEI) scan.

6. The system of claim 1, wherein said at least one inference is the presence of a railcar within said railyard.

7. The system of claim 1, wherein said first data includes automatic equipment identification (AEI scan) information and location information.

8. The system of claim 1, wherein said at least one inference is a location and orientation of a railcar within said railyard.

9. The system of claim 1, wherein said first data includes acceleration information, motion information, a global navigation satellite system (GNSS) location, and a compass heading.

10. The system of claim 1, wherein said at least one inference is that two or more railcars are linked.

11. The system of claim 1, wherein said at least one inference is that two or more railcars are not linked.

12. The system of claim 1, wherein said first data comprises detected impact information, motion information, acceleration information and location information from each of said two or more railcars.

13. The system of claim 1, wherein said software is configured to further perform the functions of logically building a train consist and validating the train consist.

14. The system of claim 13, wherein said function of logically building a train consist comprises the steps of:

(a) determining multiple couplings of two or more railcars, said multiple couplings resulting in a link containing all railcars in said train consist;

(b) determining uncouplings of railcars or links required to form said train consist;

(c) determining the coupling of a locomotive to said link containing all railcars in said train consist; and (d) forming a train-based wireless network consisting of a manager and at least one node from each railcar.

15. The system of claim 13, wherein said function of validating a train consist comprises:

(a) collecting data from each railcar having at least one node thereon, said data including at least speed, location and compass heading data;

(b) drawing inferences based on said data collected from each railcar having at least one node thereon;

(c) verifying that the speed, location and compass headings of each railcar having at least one node thereon is consistent with an overall motion of said train consist.

16. The system of claim 1, wherein said software is further configured to perform the function of logically unlinking railcars from a train consist and validating an inference that a railcar is not in a train consist.

17. The system of claim 16, wherein said inference that said railcar is not in the train consist is validated when data collected from two or more railcars supports a confidence level that exceeds a predetermined threshold.

18. A system for managing assets in a railyard, comprising:

one or more powered wireless gateways disposed in a railyard; and one or more railcar-based communication management units;

wherein said powered wireless gateways and said railcar-based communication management units form a railyard-based network; and wherein a computing device has access to said railyard-based network, said computing device running software configured to perform the functions of:

collecting first data from said railcar-based communication management units regarding events occurring on or the status of respective railcars;

drawing inferences from said first data regarding the state of said respective railcars;

reporting said inferences; and assigning probabilities that an inference is true for each event used in drawing said inference; and wherein at least one inference of said inferences is assigned a confidence level that said inference is true, said confidence level being a combination of probabilities of each event used in drawing said at least one inference.

19. A system for managing assets in a railyard, comprising:

one or more powered wireless gateways disposed in a railyard; and one or more railcar-based communication management units;

wherein said powered wireless gateways and said railcar-based communication management units form a railyard-based network; and wherein a computing device has access to said railyard-based network, said computing device running software configured to perform the functions of:

collecting first data from said railcar-based communication management units regarding events occurring on or the status of respective railcars;

drawing inferences from said first data regarding the state of said respective railcars;

reporting said inferences; and logically building a train consist by determining multiple couplings of two or more railcars;

wherein said multiple couplings are determined when data collected from each railcar having at least one node thereon supports a confidence level that exceeds a predetermined threshold.

20. The system of claim 19, wherein said multiple couplings are determined by drawing said inferences based on second data provided by said two or more railcars being coupled.

21. The system of claim 20, wherein said second data includes at least data on detected impacts and location data.

22. The system of claim 21, wherein said data on detected impacts and said location data are collected by said computing device and processed by an inference engine to create said inference that said two or more railcars have been coupled.

23. The system of claim 22, wherein said inference engine is at least partially running on at least one of a node in said railyard-based network, and said computing device.

24. The system of claim 23, wherein said inference engine draws inferences regarding which railcars are in links based on inferences regarding the coupling of railcars.

25. The system of claim 24, wherein said inference engine uses one or more of the following types of data collected from each railcar involved in a coupling event to raise or lower the confidence level that said two or more railcars are coupled:

(a) signal strength of said railyard-based network received by each railcar;

(b) motion data;

(c) speed and heading data;

(d) spline curve fit data;

(e) compass angle data;

(f) brake event data; and (g) AEI data.

26. A method of managing assets in a railyard, comprising:

software, running on a computing device having access to a railyard-based network, said software performing the functions of:

(a) collecting data from one or more railcar-based communication management units regarding events occurring on or the status of respective railcars;

(b) drawing inferences from said data regarding the state of said respective railcars;

(c) reporting said inferences; and (d) assigning a confidence level to at least one inference of said inferences.

27. The method of claim 26, wherein said confidence level represents a probability that said at least one inference is true.

28. The method of claim 27, wherein said confidence level is a combination of probabilities from one or more of said events.

* * * * *